US009759483B1

(12) United States Patent
Bero et al.

(10) Patent No.: US 9,759,483 B1
(45) Date of Patent: Sep. 12, 2017

(54) BIOMASS DRYING SYSTEM

(71) Applicant: Arizona Board of Regents, Flagstaff, AZ (US)

(72) Inventors: Bridget Bero, Flagstaff, AZ (US); Alarick Reiboldt, Flagstaff, AZ (US); Ward Davis, Flagstaff, AZ (US)

(73) Assignee: Arizona Board of Regents Acting for and on Behalf of Northern Arizona University, Flagstaff, AZ (US)

( * ) Notice: Subject to any disclaimer, the term of this patent is extended or adjusted under 35 U.S.C. 154(b) by 1247 days.

(21) Appl. No.: 13/663,359

(22) Filed: Oct. 29, 2012

Related U.S. Application Data

(63) Continuation-in-part of application No. 13/353,214, filed on Jan. 18, 2012, now abandoned.

(60) Provisional application No. 61/552,572, filed on Oct. 28, 2011, provisional application No. 61/527,021, filed on Aug. 24, 2011.

(51) Int. Cl.
*F26B 3/08* (2006.01)

(52) U.S. Cl.
CPC ..... *F26B 3/08* (2013.01)

(58) Field of Classification Search
CPC ..... F26B 3/0923; F26B 17/10; F26B 3/0926; F26B 11/028; F26B 23/002; F26B 3/12; F26B 3/08; F26B 3/084; F26B 11/022; F26B 1/005; F26B 3/082; F26B 3/10; F26B 2200/02; F26B 23/028; F26B 7/00; F26B 17/00; F26B 11/0445; B01D 1/18; B01J 2/16; B01J 8/44; B01J 8/384; B07B 7/086
USPC ..... 34/589, 588, 583, 565, 359, 369; 432/58
See application file for complete search history.

(56) References Cited

U.S. PATENT DOCUMENTS 2,929,152 A * 3/1960 Berner ..... C01B 11/185 34/169
3,263,339 A * 8/1966 Brown ..... B01J 8/16 219/388
3,484,948 A * 12/1969 Whelan ..... B01J 8/36 165/104.16
3,680,222 A * 8/1972 Edmonds ..... B01F 13/0283 34/589

(Continued)

OTHER PUBLICATIONS

Ferguson, "Cut and Dried," Sun Staff Reporter, Oct. 3, 2010, 2 pages, retrieved from: www.azdailysun.com.

(Continued)

*Primary Examiner* — Kenneth Rinehart
*Assistant Examiner* — Wes Anderson, Jr.
(74) *Attorney, Agent, or Firm* — IPTechLaw

(57) ABSTRACT

A fluid product dryer and related methods. Implementations of a method for drying particles may include: introducing particles through an inlet into a first fluid bed section; migrating the particles onto a bed deck; injecting a gas towards the particles through openings in the bed deck; migrating some of the particles through a variable-sized gate opening between the bed deck and a riser; migrating a portion of the particles into the riser; propelling the portion of the particles in the riser upwards by an injection of a gas into the riser; directing a first fraction of the portion of the particles out of the first fluid bed section and into a second fluid bed section through an outlet using a deflector feature; and directing a second fraction of the portion of the particles onto a bed deck of the second fluid bed section by interaction with an impingement feature.

19 Claims, 17 Drawing Sheets

(56) References Cited

U.S. PATENT DOCUMENTS

| | | | | | |
|---|---|---|---|---|---|
| 4,033,555 | A * | 7/1977 | Fong | B01J 8/44 | 366/101 |
| 4,400,150 | A * | 8/1983 | Smith | B01J 8/1818 | 110/245 |
| 4,627,173 | A | 12/1986 | O'Hagan et al. | | |
| 5,039,301 | A * | 8/1991 | Allen | B01J 8/386 | 110/245 |
| 5,305,533 | A * | 4/1994 | Alexander | F26B 11/028 | 34/108 |
| 5,406,914 | A * | 4/1995 | Hyppanen | B01J 8/1836 | 110/245 |
| 5,468,369 | A * | 11/1995 | Muldowney | C10G 11/18 | 208/113 |
| 5,782,010 | A * | 7/1998 | Boersen | B01D 1/18 | 34/359 |
| 6,298,579 | B1 * | 10/2001 | Ichitani | B03B 4/00 | 209/154 |
| 8,651,282 | B2 * | 2/2014 | Ness | B03B 4/06 | 209/488 |
| 2007/0193926 | A1 * | 8/2007 | Ness | B03B 4/06 | 209/133 |

OTHER PUBLICATIONS

Bero, et al., "Low temperature fluidized wood chip drying with monoterpene analysis," European Journal of Wood and Wood Products, Jan. 18, 2011, 8 pages.

* cited by examiner

BIOMASS DRYING SYSTEM

CROSS REFERENCE TO RELATED APPLICATIONS

This document claims the benefit of the filing date of U.S. Provisional Patent Application 61/552,572, entitled "Fluid Bed Dryer and Method of Use" to Ward B. Davis and Alarick K. Reiboldt which was filed on Oct. 28, 2011, the disclosure of which is hereby incorporated entirely herein by reference.

This application is also a continuation-in-part application of the earlier U.S. Utility Patent Application to Bridget Bero, Ward B. Davis, and Alarick K. Reiboldt entitled "Biomass Drying System," application Ser. No. 13/353,214, filed Jan. 18, 2012, now pending, which claims priority to U.S. Provisional Patent Application 61/527,021, entitled "Low-Temperature Woody Biomass Drying System" to Bridget Bero, Ward B. Davis and Alarick K. Reiboldt which was filed on Aug. 24, 2011, the disclosures of which are hereby incorporated entirely herein by reference.

BACKGROUND

1. Technical Field

Aspects of this document relate generally to particle drying systems. Implementations relate to biomass drying systems.

2. Background Art

Drying systems are used to reduce the moisture content of particles. Biomass drying systems are used to reduce the moisture content of biomass so that it can be rendered more usable for various applications, particularly those where the biomass is burned as a fuel for generation of heat, steam, or electrical power.

SUMMARY

Implementations of a method for drying particles using a fluid bed dryer may include: introducing a plurality of particles through an inlet into a first fluid bed section of the fluid bed dryer; migrating the plurality of particles onto a bed deck of the first fluid bed section; injecting a gas towards the plurality of particles through openings in the bed deck; migrating some of the plurality of particles towards and through a variable-sized gate opening included between the bed deck and a riser, migrating a portion of the plurality of particles into the riser; propelling the portion of the plurality of particles in the riser substantially upwards through the riser by an injection of a gas into the riser; directing a first fraction of the portion of the plurality of particles in the riser out of the first fluid bed section and into a second fluid bed section through an outlet using a deflector feature; and directing a second fraction of the portion of the plurality of particles in the riser onto a bed deck of the second fluid bed section by interaction with an impingement feature.

Implementations of a method for drying particles using a fluid bed dryer may include one, all, or any of the following:

The method may further include angling the bed deck of the first fluid bed section and the bed deck of the second fluid bed section at an angle to a ground surface below the fluid bed dryer so that some of the plurality of particles move towards and through the variable-sized gate opening at least partly through gravitational force.

Migrating a portion of the plurality of particles into the riser may further include directing some of the plurality of particles proximate a recessed portion of a riser baffle on one side of the riser and a recess of the riser baffle.

The method may further include adjusting a size of the variable-sized gate opening with a riser gate feature, wherein the riser baffle includes the riser gate feature, and the riser baffle includes a first plate, and the riser gate feature includes a second plate slidably coupled to the first plate.

The method may further include adjusting the injection of the gas into the riser using a nozzle baffle.

Migrating some of the plurality of particles towards and through a variable-sized gate opening may further include migrating some of the plurality of particles past one of: variable-sized openings in the bed deck of the first fluid bed section; variable-shaped openings in the bed deck of the first fluid bed section; openings, in the bed deck of the first fluid bed section, that decrease in size along a longest length of the bed deck of the first fluid bed section; openings, in the bed deck of the first fluid bed section, that increase in size along the longest length of the bed deck of the first fluid bed section; openings, in the bed deck of the first fluid bed section, including rectangular slits that have a longest length substantially perpendicular to the longest length of the bed deck of the first fluid bed section, and oval-shaped openings in the bed deck of the first fluid bed section.

The method may further include tilting the fluid bed dryer to simultaneously alter: an angle between the bed deck of the first fluid bed section and a ground surface below the fluid bed dryer, and; an angle between the bed deck of the second fluid bed section and the ground surface.

Injecting a gas towards the plurality of particles may include injecting a heated gas towards the plurality of particles, the heated gas having a temperature between about 200 degrees Fahrenheit and about 500 degrees Fahrenheit.

Injecting a gas towards the plurality of particles may include injecting intermittent pulses of the gas towards the plurality of particles to prevent rat holing.

Implementations of a fluid bed dryer may include: a plurality of fluid bed sections coupled together in sequence, each fluid bed section including: an inlet for introducing particles into the fluid bed section; a bed deck configured to receive the particles for drying; a plurality of openings in the bed deck configured to transfer a gas into the fluid bed section for contacting with the particles; a riser proximate an end of the fluid bed section, the riser including a riser baffle, the riser baffle including a riser gate feature; a variable-sized gate opening defined by the riser gate feature and the bed deck, the variable-sized gate opening configured to allow a portion of the particles to pass therethrough into the riser, and an outlet configured to allow a fraction of the portion of the particles to exit the fluid bed section, wherein the riser is configured to transfer the fraction of the portion of the particles out of the fluid bed section through the outlet by a substantially upward flow of a gas through the riser; and wherein the fluid bed dryer is configured to be tilted to alter an angle of each bed deck relative to a ground surface below the fluid bed dryer.

Implementations of a fluid bed dryer may include one, all, or any of the following:

Each bed deck may be configured to be independently tilted to alter an angle of the bed deck relative to the ground surface.

At least one of the riser baffles may include one of a recessed portion at a top of the riser baffle and a recess at a bottom of the riser baffle.

At least one of the fluid bed sections may further include a nozzle baffle configured to adjust an amount of gas entering the riser.

At least one of the fluid bed sections may further include a drop out feature at a bottom of the riser configured to remove undesirable material present in the portion of the particles entering the riser.

At least one of the fluid bed sections may further include a deflector configured to one of deflect a first fraction of the particles exiting the riser out of the fluid bed section and deflect a second fraction of the particles exiting the riser back into the fluid bed section for further drying.

At least one of the riser baffles may include a first plate and the riser gate feature of the riser baffle may include a second plate slidably coupled to the first plate.

At least one of the fluid bed sections may include an impingement feature configured to redirect gas and particles entering the fluid bed section towards a substantially downward direction.

At least one of the fluid bed sections may be substantially housed within one of a vehicle trailer and a shipping container.

The plurality of openings in at least one of the bed decks may include one of: variable-sized openings; variable-shaped openings; openings that decrease in size along a longest length of the bed deck; openings that increase in size along the longest length of the bed deck; rectangular slits that have a longest length substantially perpendicular to the longest length of the bed deck; and oval-shaped openings.

Implementations of a fluid bed dryer for drying biomass may include: a first fluid bed section and a second fluid bed section proximate to the first fluid bed section, the first fluid bed section including: a first bed deck configured to receive biomass particles for drying; a plurality of openings in the first bed deck configured to transfer a heated gas into the first fluid bed section for drying the biomass particles; a riser proximate an end of the first fluid bed section, the riser including a riser baffle; a gate opening defined by the riser baffle and the bed deck, the gate opening configured to allow a portion of the biomass particles to pass therethrough into the riser; and a deflector configured to deflect a fraction of the biomass particles exiting the riser out of the first fluid bed section and into the second fluid bed section; and the second fluid bed section including: an impingement feature configured to redirect gas and biomass particles exiting the first fluid bed section towards a substantially downward direction; a second bed deck configured to receive the biomass particles redirected by the impingement feature; and a plurality of openings in the second bed deck configured to transfer a heated gas into the second fluid bed section for further drying of the biomass particles redirected by the impingement feature.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1:
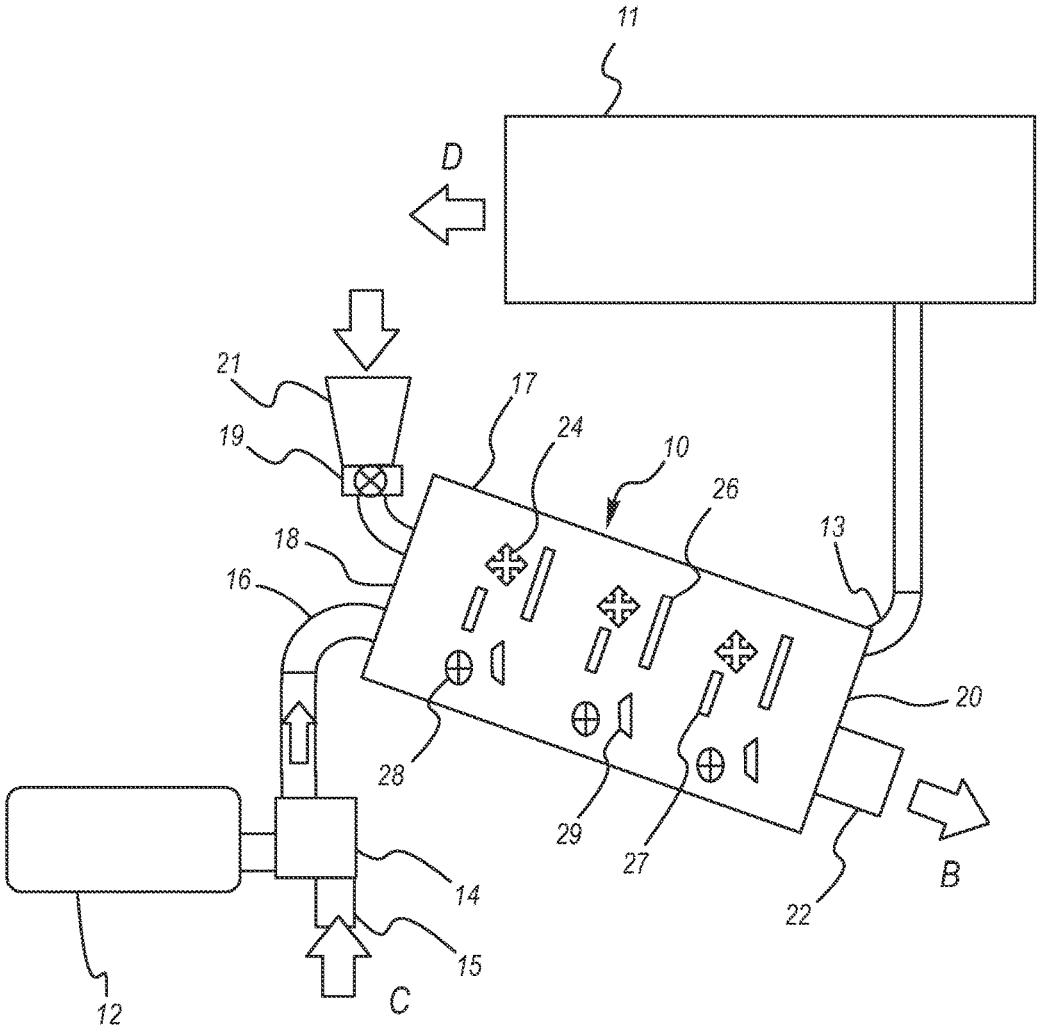
FIG. 1 is a side view of an implementation of a fluid bed dryer and burner providing dryer gas, and a filtration unit.

This disclosure, its aspects and implementations, are not limited to the specific components, assembly procedures or method elements disclosed herein. Many additional components, assembly procedures and/or method elements known in the art consistent with the intended fluid bed dryers and dryer systems and will become apparent for use with particular implementations from this disclosure. Accordingly, for example, although particular implementations are disclosed, such implementations and implementing components may include any shape, size, style, type, model, version, measurement, concentration, material, quantity, method element, step, and/or the like as is known in the art for such fluid bed dryers and dryer systems, and implementing components and methods, consistent with the intended operation and methods.

Harvesting forest products produces a substantial amount of biomass material in the form of slash. Slash includes coarse and fine woody debris, including wood chips. This biomass material is used as a fuel for numerous systems. Prior to using the biomass waste as fuel it is optionally dried to a sufficient degree and/or ground and/or pelletized to form compressed wood pellets/particles. Wood chips from living trees typically contain about 50% water weight, and the chips are generally dried to about 12% water weight in preparation for pelletizing into wood pellets. Various systems exist for drying the biomass material. One example is a rotary kiln (and other similar plug-flow-type) dryer. Another example is the belt dryer which conveys wood chips along a belt using lower temperature air to remove the moisture. Another example is found in U.S. Pat. No. 4,628,833 to Michael O'Hagan, et al., entitled "Fluid Bed Hog Fuel Dryer," issued Dec. 16, 1986, the disclosure of which is hereby entirely incorporated herein by reference.

In implementations of a rotary dryer, wet wood chips and hot gas are fed together into the inlet of the rotating drum dryer, which is sloped downward to the outlet. The dryer gas is generally a combination of flue gas from a burner, which supplies the necessary heat, and a recycled stream of the gas exiting through the outlet end of the rotating drum. This blended dryer gas is often 600° F. or higher. At the outlet end, the dried wood and off-gas usually exit together and are separated in a cyclone. Some of the gas is released to the atmosphere while the rest is recycled back to mix with the heater's combustion products.

The inside of the rotary drum dryer contains lifters which carry the chips up the side of the drum so they will drop into the gas stream flowing down the length of the drum. The chips are heated by the gas through three mechanisms: 1) contact with the dryer gas as they fall; 2) radiation and conduction to the surface of the chip bed from the hot gas; and 3) by conduction of the hot drum wall, which is heated largely by radiation during much of the rotation when no chips are touching it.

The present device is a fluid bed dryer in which a material to be dried, such as wood chips, enters at an inlet end and then passes through a series of dryer beds and out the outlet end. Transport of the material through the dryer occurs by gravity and by pneumatic conveyance at the outlet of each bed.

Materials that may be dried include any suitable material including but not limited to biomass materials such as wood chips, wood particles, grasses, grain, such as corn or rice, and vegetables. In addition, synthetic materials may also be dried in the fluid bed dryer described herein, including but not limited to polymeric material, rubber, and the like which may require the removal of a solvent or any other volatile processing aid. Materials that may be dried may have any suitable shape including regularly or irregularly shaped particles or elements. Regularly shaped materials may be spherical, rectangular or cubic for example. Irregularly shaped objects, may be generally planar such as a wood chip, or have any other irregular shape. Particles may range in size and packing propensity. For simplicity, materials that may be dried will herein be referred to as particles.

Any suitable means to provide heated air or dryer gas may be used for the dryer described herein. In implementations the dryer gas may be air-quenched flue gas from burning wood, natural gas, or oil, or it can come from heat exchange of air with process fluids from other parts of a processing plant. The dryer gas enters the dryer into a plenum beneath the beds at the dryer inlet end. The dryer gas flows up through the beds, where it may become nearly saturated with water and flows out the top of the dryer. The dryer gas may then pass through a dust removal device such as a cyclone, or a filtration device. The cleaned gas may then enter a blower that may be configured to create a slight vacuum to pull the gas through the dryer system. The blower exhaust gas may go into the atmosphere or to a bag house for further dust removal.

Dryer gas enters the bed portion through any suitable openings in the bed deck. In implementations the openings are slots oriented in the width direction of the dryer that create jets to promote mixing while drying the particles. The dryer gas flow rate and openings in the bed deck may be configured in any suitable way to ensure enough mixing and local fluidization of the particles to allow acceptable flow of the particles through the bed section. The rate of delivery of the particles to the dryer, or dryer bed section, may be controlled to ensure proper movement and fluidization of the particles. In addition, the rate of delivery of the particles may be controlled to provide a desired level or amount of moisture or liquid removal from the particles. The dyer gas flow and openings in the bed deck may be configured in any suitable way to ensure enough mixing and local fluidization of the particles to allow acceptable flow of the particles through the bed section.

The dryer, as described herein, is made up of several bed sections. Wet particles travel sequentially from dryer bed to dryer bed. In implementations each bed section includes a dryer bed having a bed deck and a riser portion. The particles enter the dryer bed and are moved by gravity and air flow through openings in the sloped bed floor to the bottom of the bed section, where they approach the riser. The riser is a channel configured between a divider and a riser baffle. The particles pass through an opening or gate between the riser baffle and the bed deck, and then through the riser where they are conveyed pneumatically upward by dryer gas entering at the base of the riser. Particles are fluidized and rise rapidly in the riser and are directed to the next section.

The dryer is configured with a nozzle baffle that controls the amount of dryer gas entering into the riser. The nozzle baffle may include a flow adjustment feature whereby the nozzle baffle may be moved to change the amount of dryer gas entering the riser. In implementations the nozzle baffle has a pivot end and an extended end, and the nozzle baffle may be rotated about the pivot to adjust the opening between the dryer gas plenum and the riser. The flow adjustment feature may be manual or automated, including at least one sensor that monitors at least one processing parameter, such as a pressure drop through the riser.

At the base of the riser, a dryer may include a drop out feature, whereby heavy particles, or foreign objects such as rocks, may be removed from the riser. The drop out feature may be configured to contact the nozzle baffle to create a flow path for the dryer gas. The drop out feature may include an adjustment feature whereby the drop out may be opened to a certain extent to allow the removal of undesirable materials from the riser. The drop out adjustment feature may be manual or automated, including at least one sensor that monitors at least one processing parameter, such as a pressure drop through the riser.

The gate opening may be adjusted by a riser gate feature as described herein. The riser gate feature may include a gate adjustment feature, or a means or mechanism to move at least a portion of the riser baffle to adjust the gate opening. For example, the riser baffle may be moved up or down through a connection to a lever or knob on the outside surface of the dryer. In implementations the riser baffle includes at least two components, wherein one component may be adjusted to change the gate opening, such as a riser gate plate configured such that it may move up and down. The riser gate adjustment feature may be manual or automated. The automated gate adjustment feature may include at least one sensor that monitors at least one processing parameter such as amount of particles in a bed section, or moisture content of the exhaust dryer gas for example.

A deflector feature may be configured above the riser to direct particles to the next bed section or to an outlet. The deflector feature may also be configured to divert some portion of the particles back to the previous bed section and the deflector feature may have a transfer adjustment feature. This transfer adjustment feature may allow for positional or rotational adjustment of the deflector feature to control the amount of particles transferred. In implementations the transfer adjustment feature is automated having at least one sensor for feedback of at least one processing parameter such as the amount of chips in a bed section.

A bed section may further include an impingement feature located above a bed in the stream of particles and air from a previous bed section. The impingement feature may slow or direct the particles from the previous section into the bed, and may further be configured to direct the dryer gas flow from the previous bed section out of the dryer, and in implementations, into an exhaust plenum. The impingement feature and deflector feature may be adjusted in conjunction with each other to control the transfer of particles and dryer gas flow through the dryer.

As described herein, a fluid bed dryer having a plurality of drying bed sections whereby particles to be dried may be transferred from bed section to a an adjacent bed section, is provided. The bed dryer, as described herein, may include manual or automated adjustment features to control the process.

Referring now to FIG. 1, in implementations any suitable mechanism may be used to provide heated air or dryer gas for a fluid bed dryer (dryer) 10. In implementations the dryer gas may be airquenched flue gas from burning wood, natural gas, or oil. A burner 12 provides heated air that is then mixed in a mixer 14 with air C entering through an inlet port (inlet) 15. The heated air is transferred to the fluid bed dyer 10 through the dryer gas inlet 16. The dryer gas may also come from a heat exchanger or from any other suitable source. The dryer gas may also enter the dryer 10 along the length of the dryer 10, such as at the beginning of a dryer bed section. The dryer 10 may be designed to accommodate any suitable pressure drop from the inlet 15 to the dryer gas exhaust or outlet 13, including but not limited to 2, 3, 4, 6, 8, or 20 inches of water, or 1, 2 or more than 4 psi. The dryer gas enters the dryer 10 into a plenum 30 (see FIG. 3) beneath the bed decks 32 (see FIG. 3) at fluid bed dryer inlet end 18. The dryer gas flows up through the bed decks 32, where it may become nearly saturated with water, and subsequently flows out of the dryer 10 at outlet end 20. The dryer gas may then pass through a dust removal device 11 such as a cyclone or a filtration device as shown if FIG. 1. The cleaned gas may then enter a blower that may be configured to create a slight vacuum to pull the gas through the dryer system. The blower exhaust gas may go into the atmosphere or to a bag house for further dust removal.

Materials that may be dried include any suitable material including but not limited to biomass materials such as wood chips, wood particles, grasses, grain, such as corn or rice, vegetables, or synthetic materials, including but not limited to polymers, or foams, requiring the removal of a solvent or any other volatile processing aid. Materials that may be dried may have any suitable shape including regularly or irregularly shaped particles or elements. Regularly shaped materials may be spherical, rectangular or cubic, for example. Irregularly shaped objects, may be generally planar such as a wood chip, or have any other irregular shape. For simplicity, materials that may be dried will herein be referred to as particles. Referring still to FIG. 1, a particle input (input) (inlet) 21 or opening for the material, or particles, to be dried is shown. The input 21 may be a hopper or be fed from another apparatus such as a wood chipper. In other implementations any type of inlet 21 may be used such as, but not limited to, an opening. In implementations a valve 19 may be configured at the particle input 21. In implementations the valve 19 may be configured to minimize the loss of air. A rotary air lock valve may be used to control the flow and minimize air ingress or egress from the fluid bed dryer 10.

Figure 2:
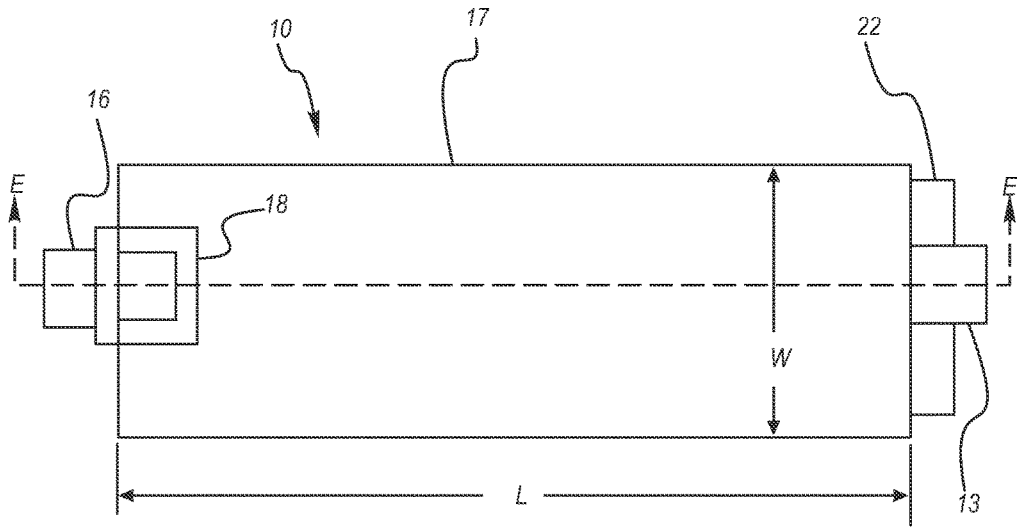
FIG. 2 is a top view of a fluid bed dryer.
Figure 3:
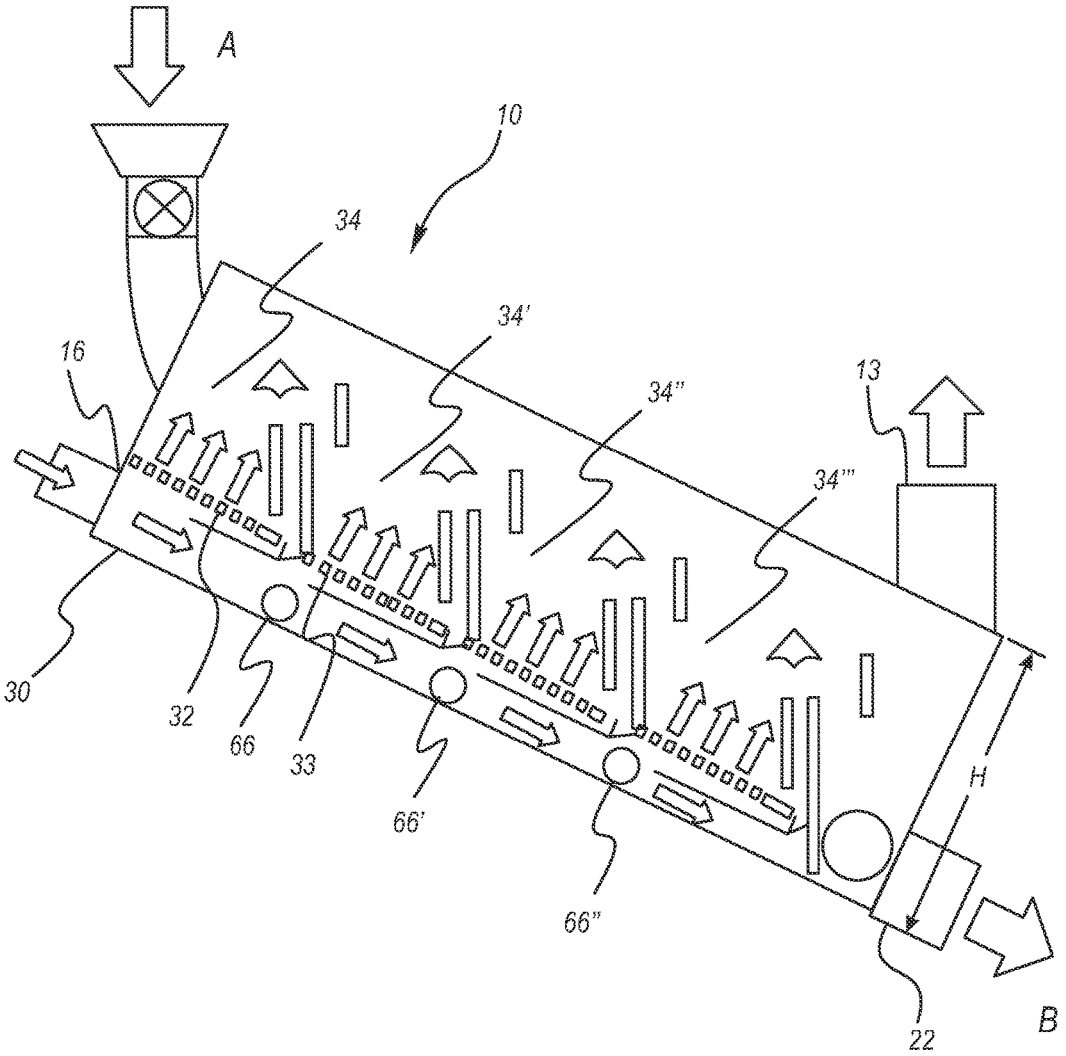
FIG. 3 is a cross sectional view taken along sectional line E-E in FIG. 2.

Referring now to FIG. 2, in implementations a fluid bed dyer 10 includes a housing 17, a dryer gas inlet 16, a particle inlet 18, a dryer gas exhaust or outlet 13, and a particle outlet (outlet) 22. The fluid bed dryer 10 may be any suitable dimension, having a length L and width W, as shown in FIG. 2, and height H, as shown in FIG. 3. In implementations the dryer 10 may have any suitable length L including but not limited to a length L greater than about 2 ft, 4 ft, 6 ft, 10 ft, 20 ft or more. In implementations the dryer 10 may have any suitable height H including but not limited to a height H greater than about 1 ft, 2 ft, 4 ft, 6 ft, 10 ft or more. In implementations the dryer 10 may have any suitable width W including but not limited to a width W greater than about 1 ft, 2 ft, 4 ft, 6 ft, 10 ft or more. In implementations the fluid bed dryer 10 may have a length L greater than the width W. The housing 17 may be constructed out of any suitable material that can withstand the dryer gas temperatures. The housing 17 may include, for example, metal, such as sheet metal, glass or polymeric materials. In implementations at least a portion of the fluid bed dryer 10 includes a translucent or transparent material. For example, one side, or a portion of a side of the fluid bed dryer 10 may include a glass or temperature resistant polymeric material that is at least translucent. A transparent side of the fluid bed dryer 10 would allow for visual monitoring the status of the dryer 10, such as the amount of particles in the bed sections 34, 34', 34", 34'" (see FIG. 3) and/or the condition of the risers 42 (see FIG. 5).

Referring to FIG. 3, the cross sectional view of the fluid bed dryer taken along line E-E shown in FIG. 2, in implementations the dryer gas enters a plenum 30 beneath the bed deck 32. The dryer gas flows through openings 33 in the bed deck 32 indicated by the arrows. As shown in FIG. 3, the fluid bed dryer 10 in implementations has four fluid bed sections 34, 34', 34" and 34'". Any suitable number of fluid bed sections may be configured into the fluid bed dryer 10, such as but not limited to 2, 3, 4, 5, 6, 7, 8, 9, 10, 12 or more than 12. In addition, the configuration of each fluid bed section may be different, having for example, different dimensions or lengths, different bed deck 32 configurations or openings 33 therein, and/or different slopes of the bed deck 32, and the like. The bed deck 32 may be sloped in relation to the fluid bed dryer 10 and/or the fluid bed dryer 10 may be configured at a slope or angle offset from a horizontal position, as shown in FIG. 3. In implementations this may promote the transfer of particles through the dryer 10 by gravity.

Figure 4A:
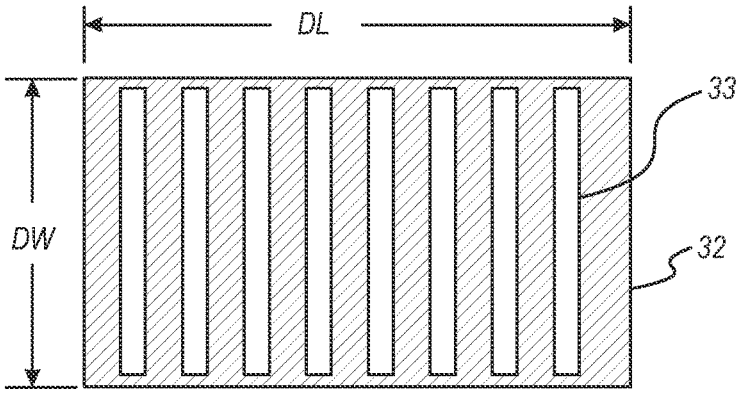
FIG. 4A is a top view of an implementation of a bed deck.
Figure 4B:
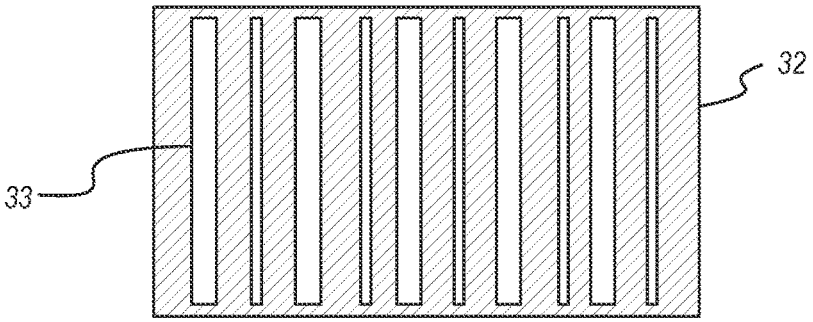
FIG. 4B is a top view of an implementation of a bed deck.
Figure 4C:
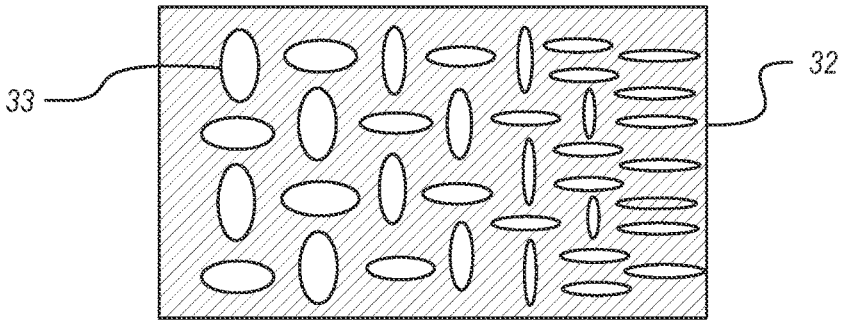
FIG. 4C is a top view of an implementation of a bed deck.

The bed deck 32 as shown in FIG. 3 may include a single piece of material having openings 32 therein, or it may include a plurality of pieces of material that are configured to create spaces or openings 32 there between. In implementations the openings 33 are slots oriented in the width direction of the fluid bed dryer 10 that create jets to promote mixing while drying the chips. The bed deck 32 may be configured with any suitable openings 33, such as slots, holes or irregularly shaped openings 33. The openings 33 may be configured in a uniform pattern in the bed deck 32, or in a non-uniform configuration. In addition, the size or number of openings 33 may vary across the surface of the bed deck 32 as shown in FIG. 4C. For example, the size of the openings 33 may vary from the dryer gas inlet 16 end of the bed deck 32 to the riser 42 end of the bed deck 32. In implementations a gradient in opening 33 configuration from one end to the other may improve the movement or drying efficiency or rate of particles. As shown in FIGS. 4A, 4B and 4C, any number or types of opening 33 configurations may be used. FIG. 4A shows a bed deck 32 having regularly shaped slot openings 33 extending across the bed deck width DW of the bed deck 32, whereas FIG. 4B shows alternating slot openings 33 along the bed deck length DL. FIG. 4C shows a bed deck 32 having irregularly shaped openings 33 and a variation in opening 33 area along the length of the bed deck 32.

The bed deck 32 may have variable openings 33. For example the bed deck 32 may include one or more pieces of material having openings 33 and another piece of material that may be moved to close or open the openings 33 in the first sheet. For example, a first sheet of metal may have openings 33 therein, and a second metal sheet may be configured generally parallel with and under the first sheet with openings 33 that are aligned with but larger than the openings 33 in the first sheet. When the second sheet is moved, such as by sliding along the length of the bed deck 32, the edges of the openings 33 in the second sheet may be configured to overlap with the openings 33 in the first sheet, such that the openings 33 in the first sheet are reduced in size. Further sliding of the second sheet may further close off the openings 33 in the first sheet. A bed deck 32 may be configured with variable openings 33 across the entire bed deck 32 or only over a portion of the bed deck 32. In addition, separately controlled bed deck openings 33 may be configured. For example, a first slide plate for closing of the openings 33 in the bed deck 32 and control may be configured over the first half of the length of the bed deck 32, and a second slide plate may be configured over the second half of the length. The control of the openings 33 in a variable opening configuration of the bed deck 32 may be at least partially controlled using input from at least one sensor. The control may be manual and/or automatic. For example, a slide plate may be connected with a lever that may be slid by an operator to adjust the opening 33 sizes over at least a portion of the bed deck 32. In implementations a button may be pushed and a servo or other mechanism may move the slide plate.

Figure 5:
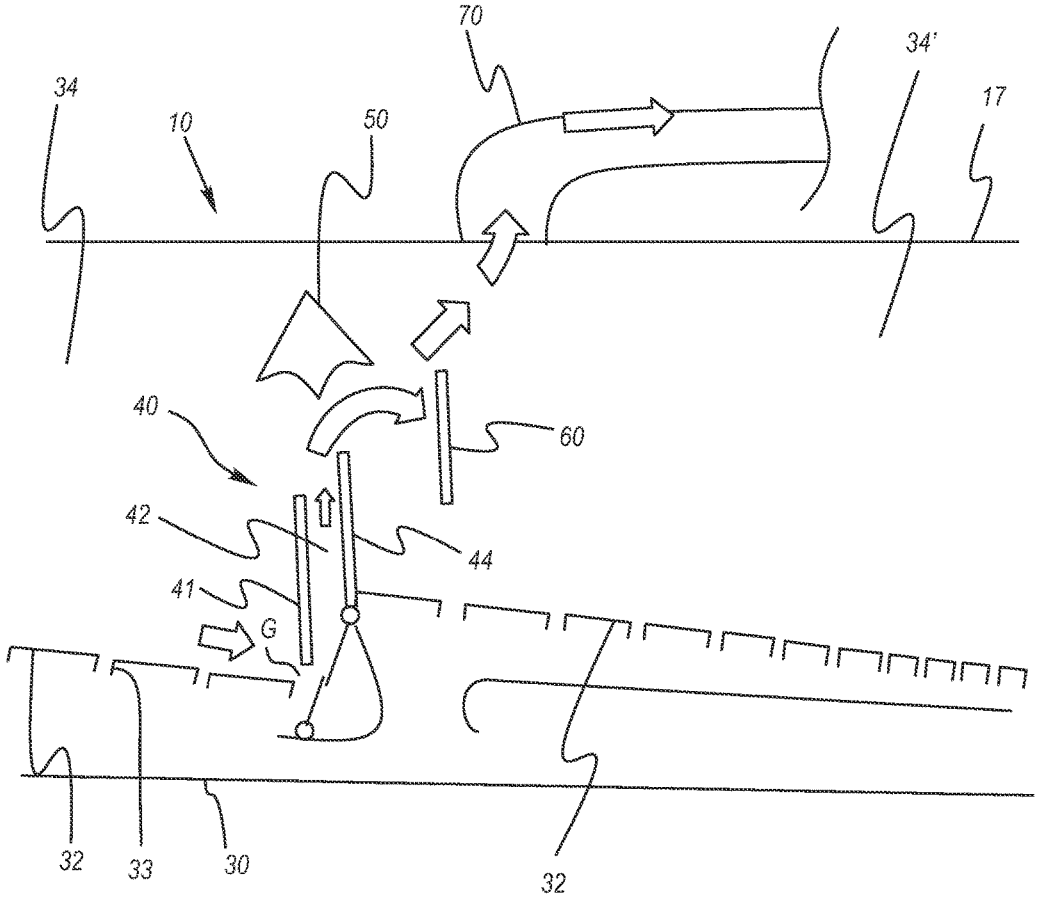
FIG. 5 is a cross sectional view of a portion of an implementation of a fluid bed dryer having a riser section, deflector feature and impingement feature.

The dryer 10 in implementations is made up of several fluid bed sections. Wet particles travel sequentially from fluid bed section to fluid bed section. Each fluid bed section (34, 34', 34", 34''') includes a dryer bed having a bed deck 32 and a riser portion 40. The particles enter the dryer bed and are moved by gravity and air flow through openings 33 in the sloped bed deck 32 where they approach the riser 40, as shown in FIG. 5. As shown in FIG. 5, the riser 42 is a channel configured between a divider 44 and a riser baffle 41. The particles pass through gate opening (gate) (opening) G between the riser baffle 41 and the bed deck 32, and then through the riser 42 where they are conveyed pneumatically upward by dryer gas entering at the base of the riser 42. Particles are fluidized and rise rapidly in the riser 42 and are directed to the next fluid bed section. The divider 44 and riser baffle 41 may have any suitable shape such as straight or planar, or curved, and may be made out of any suitable material including but not limited to metal, glass, or polymeric materials, and the like. The bed deck 32 in the second bed section 34', as shown in FIG. 5, includes a variation in openings 33 along the length of the bed deck 32. The dryer gas may be diverted by the configuration of a deflector feature (deflector) 50 and impingement feature 60, as shown in FIG. 5. The dryer gas may become saturated and may be diverted upward, and in some cases may be diverted into an exhaust plenum 70, as shown in FIG. 5

Figure 6:
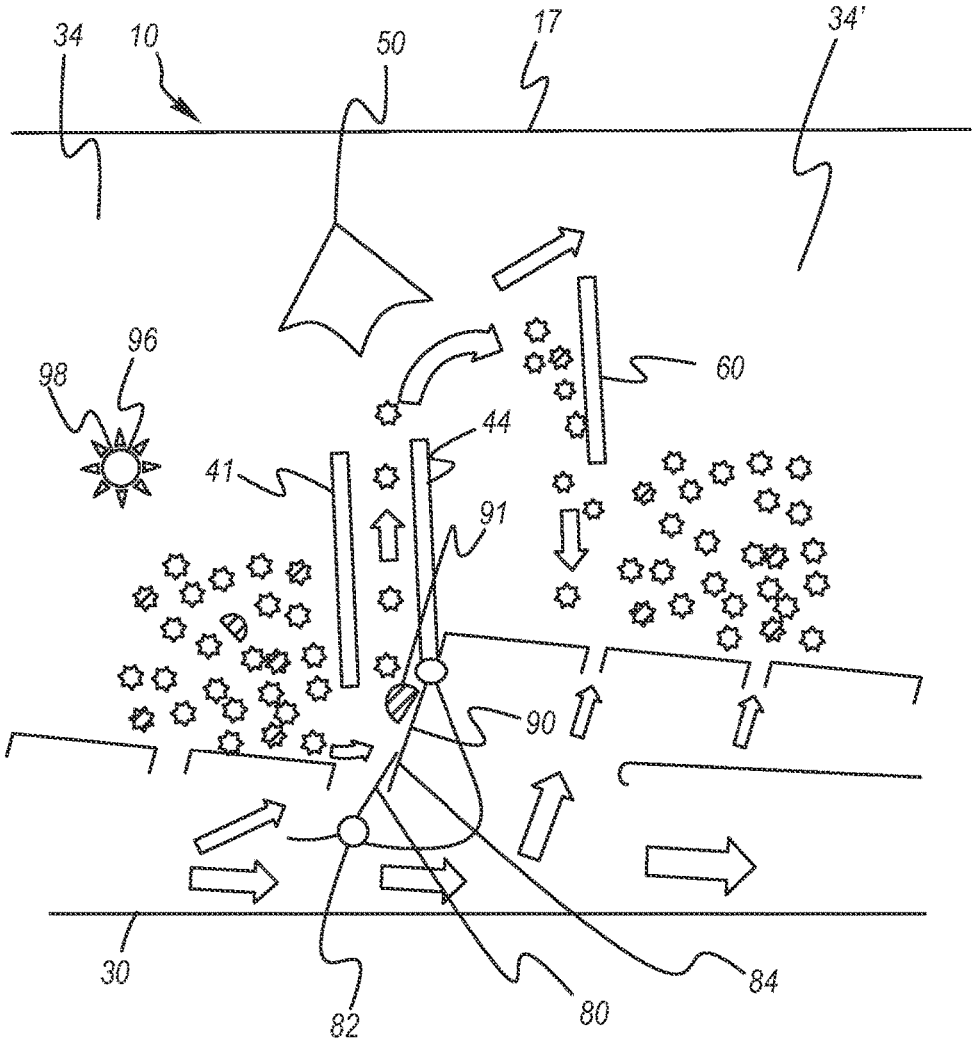
FIG. 6 is a cross sectional view of a portion of an implementation of a fluid bed dryer having an undesirable object in the riser section.

Referring now to FIG. 6, in implementations the fluid bed dryer 10 is configured with a nozzle baffle 80 that controls the amount of dryer gas entering into the riser 42. The nozzle baffle 80 may include a flow adjustment feature whereby the nozzle baffle 80 may be moved to change the amount of dryer gas entering the riser 42. In implementations the nozzle baffle 80 has a pivot end 82 and an extended end 84, and the nozzle baffle 80 may be rotated about the pivot end 82 to adjust the opening between the dryer gas plenum 30 and the riser 42. The nozzle baffle 80 may also be slid or otherwise moved to adjust the opening from the plenum 30 to the riser 42. A nozzle baffle 80 flow adjustment feature 28, as shown if FIG. 1, may be manual and may include a knob or lever for adjustment of the nozzle baffle 80. The flow adjustment feature 28 may additionally or alternatively be automated including at least one sensor 96 that monitors at least one processing parameter, such as pressure drop through the riser. In implementations the sensor 96 may include a proximity sensor 98 and may be used to determine the amount of particles in a first fluid bed section 34, and when the amount of particles increases or exceeds a predetermined limit, the nozzle baffle 80 may be opened to allow for more transfer of particles to a second fluid bed section 34'. The flow adjustment feature 28 may have manual and/or automated components or controls. The nozzle baffle 80 may have any suitable shape, and may be planar or straight, or have a curved shape. The nozzle baffle 80 may extend the width of the fluid bed section (34, 34', 34", 34'''). The nozzle baffle 80 may be made out of any suitable material including, but not limited to, metal, glass or polymeric materials.

Figure 7:
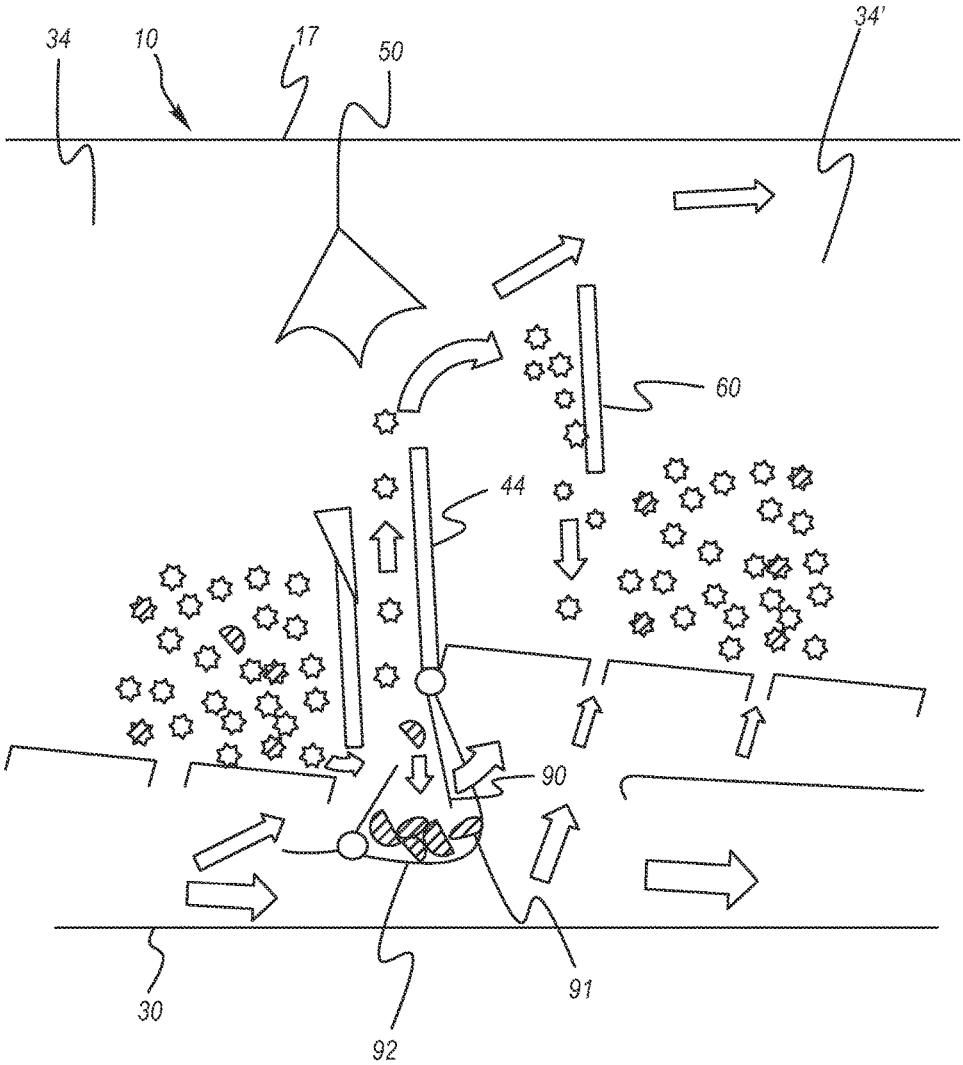
FIG. 7 is a cross sectional view of a portion of an implementation of a fluid bed dryer having a drop out feature in an open position.

At the base of the riser 42, a fluid bed dryer 10 may include a drop out feature 90, whereby undesirable material 91 such as heavy particles or foreign objects such as rocks may be removed from the riser 42, as shown in FIG. 6. Undesirable material 91 may become trapped in the riser 42 and the dryer 10 gas flow may not be sufficient to move the undesirable material 91 through the dryer 10. The drop out feature 90 may be configured to contact the nozzle baffle 80 to create a flow path for the dryer gas as shown if FIG. 6. The drop out feature 90 may include any shape or configuration such as a straight or planar shape, or curved shape and may extend the width of the fluid bed section 34, 34', 34", 34''', or the width of the bed deck 32. The drop out feature 90 may be a piece of metal, such as sheet metal, configured to extend along the width of the riser 42. In addition, the drop out feature 90 may be configured at an angle across the width W of the fluid bed dryer 10 to cause heavier undesirable material 91 to collect at one end. In FIG. 7 the drop out feature 90 is in an open configuration and undesirable material 91 has dropped into a collection area 92. The drop out feature 90 may include an adjustment feature 29 (see FIG. 1) whereby the drop out feature 90 may be opened to a certain extent to allow the removal of undesirable materials 91 from the riser 42. For example, a lever or knob may be connected with the drop out feature 90 to allow an operator to open the drop out feature 90 when desired. The drop out adjustment feature 29 may be manual and/or automated and may include at least one sensor that monitors at least one processing parameter, such as pressure drop through the riser 42. In addition, an opening in the housing 17 of the fluid bed dryer 10 may be configured to allow the removal of undesirable material 91.

Figure 8:
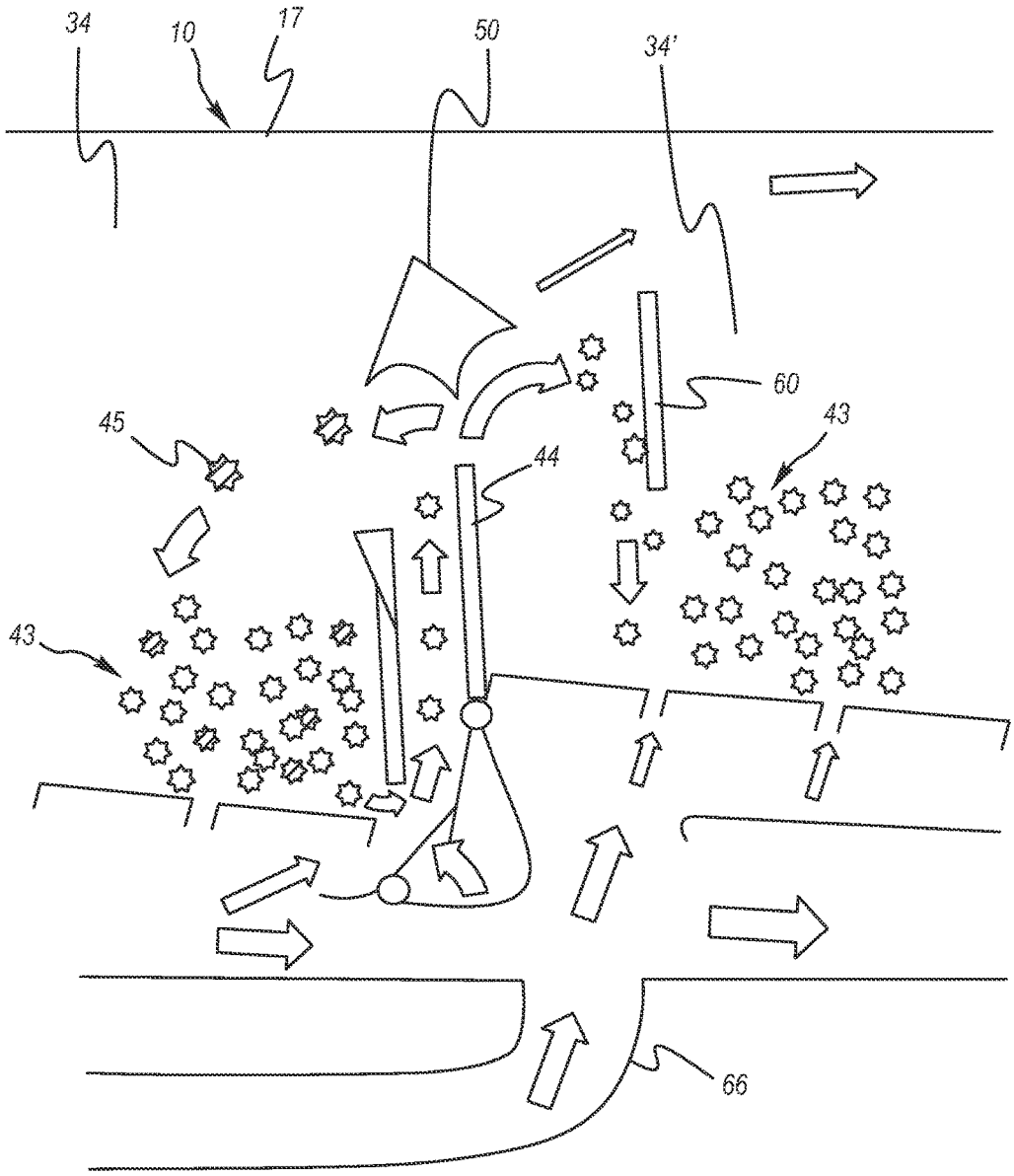
FIG. 8 is a cross sectional view of a portion of an implementation of a fluid bed dryer having a deflector feature configure to transfer a portion of the particles to a second bed section and a portion to a first bed section.

Referring to FIG. 8, a deflector feature 50 may be configured above the riser 42 to direct particles 43 to a second fluid bed section 34', or to an outlet. The deflector feature 50 may have any suitable shape including a shape having curved surfaces as shown in FIG. 8. The deflector feature 50 may extend across the width of the fluid bed section 34, 34', 34", 34'" and may include a single bent or shaped piece of material. The deflector feature 50 may also include an extruded piece of material having a regular or irregular shape. The deflector feature 50 may also be configured to divert some portion of the particles 43 back to the previous or first fluid bed section 34, as shown in FIG. 8. The deflector feature 50 may be configured to deflect wet or heavier particles 45 back into the first fluid bed section 34 for additional residence time in the dryer 10. In addition, the deflector feature 50 may have a transfer adjustment feature 24 (see FIG. 1) that may allow for positional and/or rotational adjustment of the deflector feature 50 to control the amount of particles 43 transferred. In implementations the transfer adjustment feature 24 is automated, having at least one sensor for feedback of at least one processing parameter such as amount of particles 43 in a fluid bed section 34, 34', 34", 34'".

In implementations the dryer gas may enter the dryer 10 in a plurality of locations. For example, dryer gas may enter at the beginning of one or more fluid bed sections 34, 34', 34", 34'" through a dryer gas inlet plenum (plenum) 66, 66', 66", as shown in FIG. 3 and FIG. 8 The dryer gas inlet plenum 66 may be configured in any suitable way and each plenum 66 may include an air mixing feature to allow for controlling the temperature of the dryer gas. The dryer gas may be mixed with ambient or secondary air as it enters the dryer 10. For example, the dryer gas entering the dryer 10 nearer the particle inlet 18 may be mixed with less secondary air, such that the temperature is higher than the gas entering further down the length of the dryer 10. In particular, the temperature of the dryer gas may be significantly reduced as the particles 43 become dry.

A fluid bed section may further include an impingement feature 60 located above a bed deck 32 in the stream of particles 43 and air from a previous fluid bed section, as shown in FIG. 5 through FIG. 9. The impingement feature 60 may slow or direct the particles 43 from the previous fluid bed section into a subsequent fluid bed section, and may further be configured to direct the dryer gas flow from the previous fluid bed section upward and in some cases out of the dryer 10. The impingement feature 60 may have any suitable shape or configuration, and may be planar or straight, or have a curved shape. The impingement feature 60 may be made out of any suitable material including, but not limited to, metal, glass or polymeric material, and the like. The impingement feature 60 and deflector feature 50 may be adjusted in conjunction with each other to control the transfer of particles 43 and dryer gas flow through the dryer 10. The impingement feature 60 may further include a position adjustment feature 26 (see FIG. 1), whereby the impingement feature 60 may be moved or rotated. The impingement position adjustment feature 26 may include a knob or lever or the like to manually adjust the impingement feature 60, and/or it may be automated. In implementations the impingement position adjustment feature 26 is automated having at least one sensor for feedback of at least one processing parameter, such as amount of particles 43 in a fluid bed section.

Figure 10A:
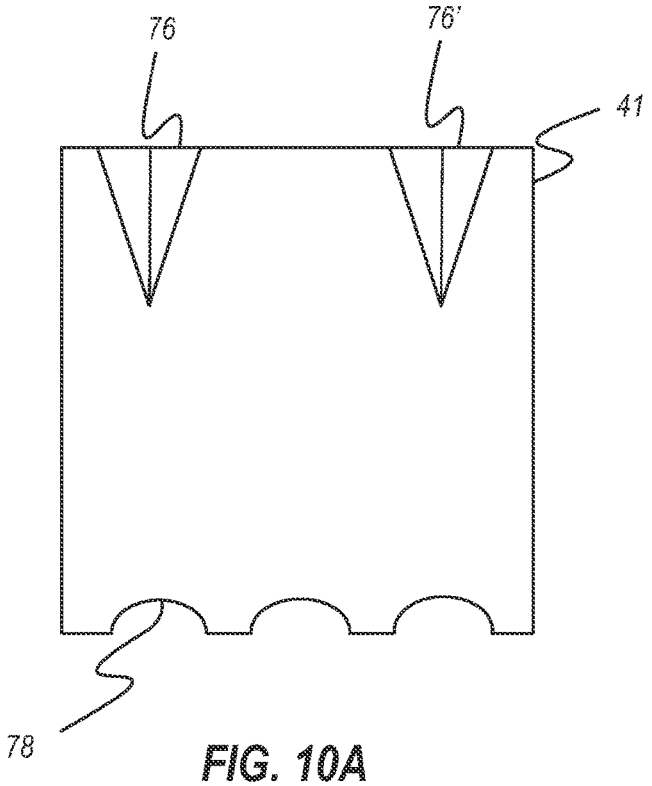
FIG. 10A is a front view of an implementation of a riser baffle having recesses extending to the top surface.
Figure 10B:
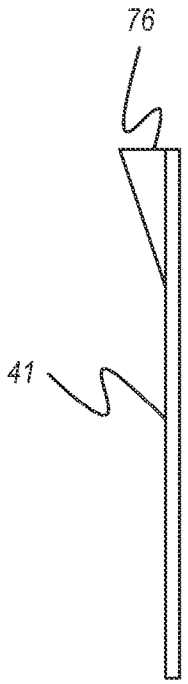
FIG. 10B is a side view of an implementation of a riser baffle having recesses extending to the top surface.
Figure 10C:
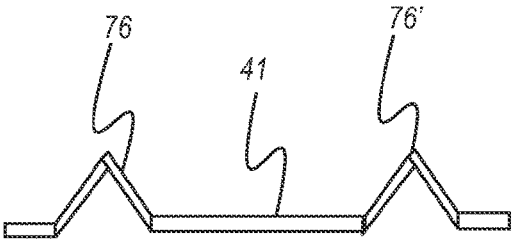
FIG. 10C is a top view of an implementation of a riser baffle having recesses extending to the top surface.
Figure 11A:
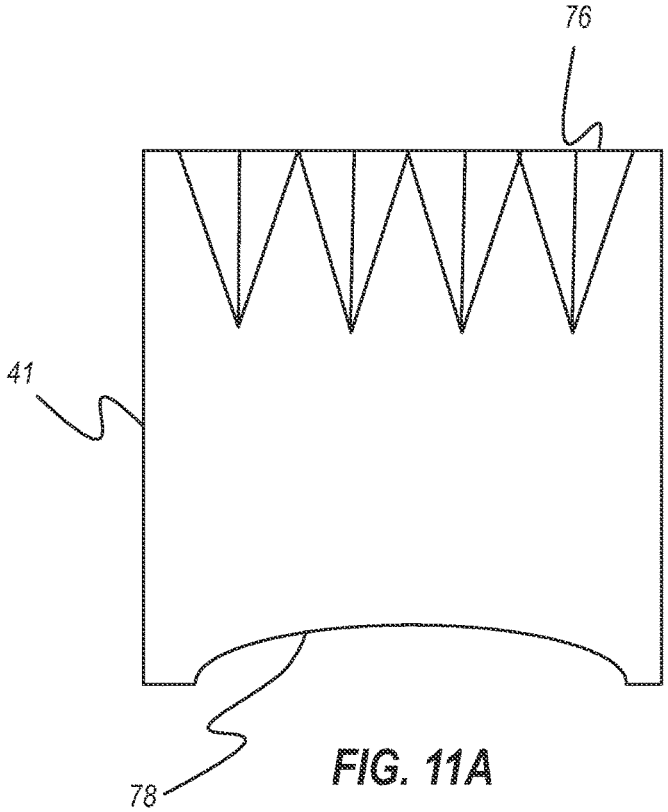
FIG. 11A is a front view of an implementation of a riser baffle having an irregularly shaped bottom surface.
Figure 11B:
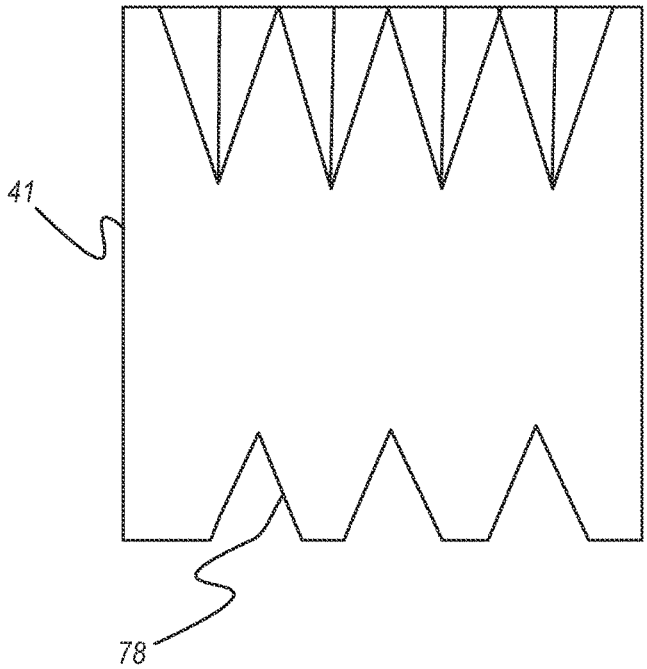
FIG. 11B is a front view of an implementation of a riser baffle having an irregularly shaped bottom surface.

Referring now to FIGS. 10A-10C, the riser baffle 41 may be configured with a recess along a portion of the surface. The recess may further enable particles to move through the riser portion 40, and may provide for the return of some particles 43 to the previous fluid bed section. In implementations the riser baffle 41 includes a recessed portion 76 and a recessed portion 76'. The recessed portions 76, 76' may have any suitable shape and in implementations may extend at least a portion down the length of the riser baffle 41 from the top surface as shown in FIG. 10B. The riser baffle 41, or riser gate feature 46, such as a secondary plate, may include one or more recesses 78 at its bottom surface, as shown in FIGS. 10A, 11A and 11B.

Figure 9:
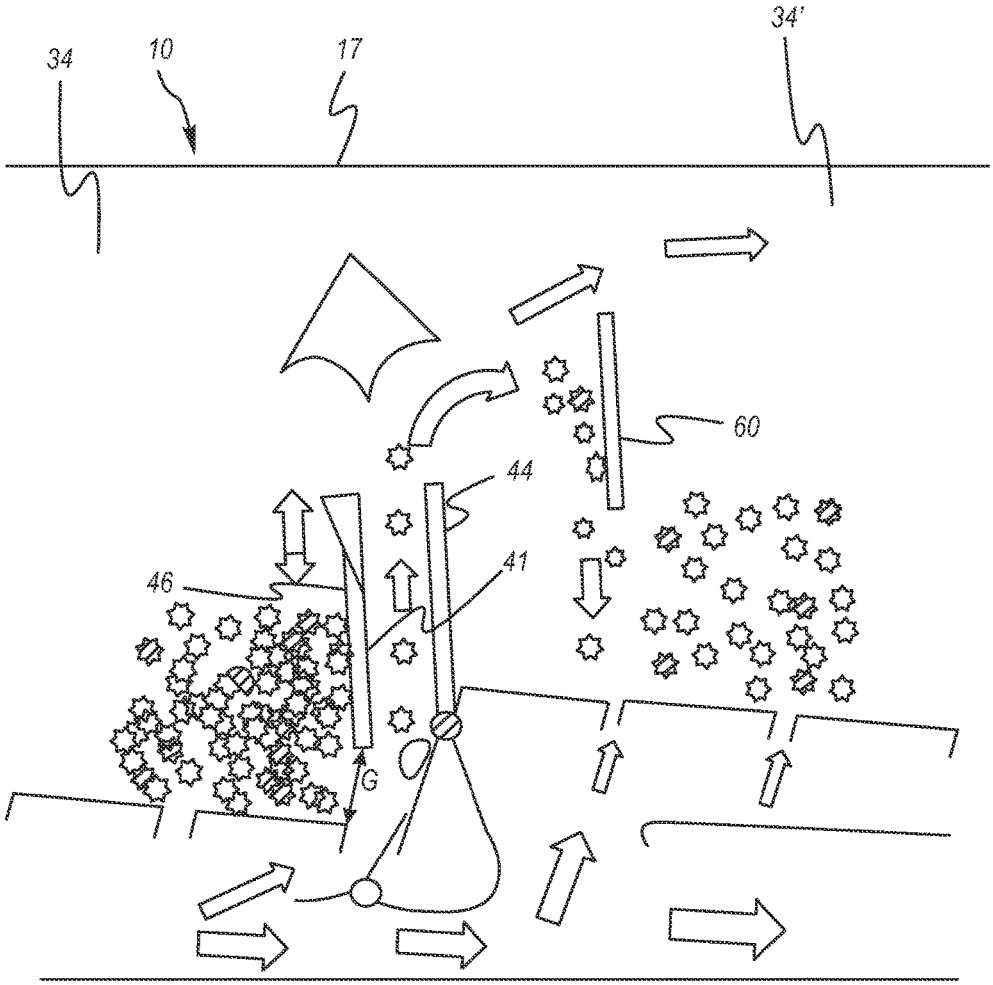
FIG. 9 is a cross sectional view of a portion of an implementation of a fluid bed dryer having a riser gate feature.
Figure 12A:
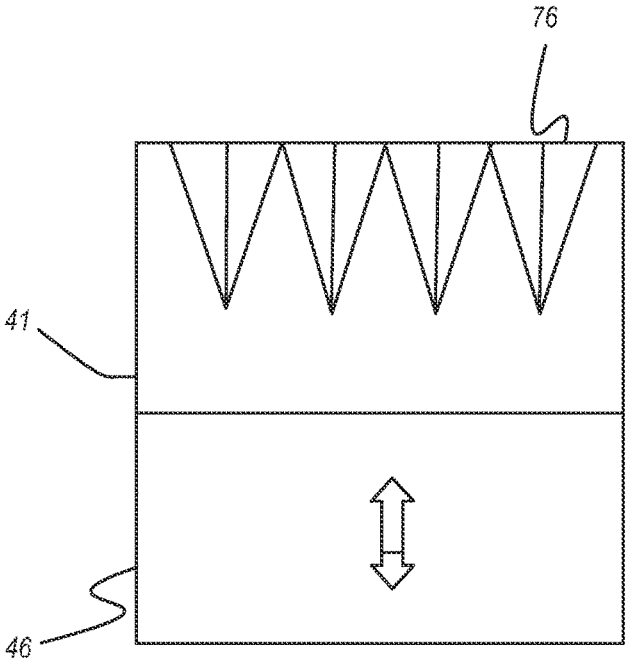
FIG. 12A is a front view of an implementation of a riser baffle and a riser gate feature.
Figure 12B:
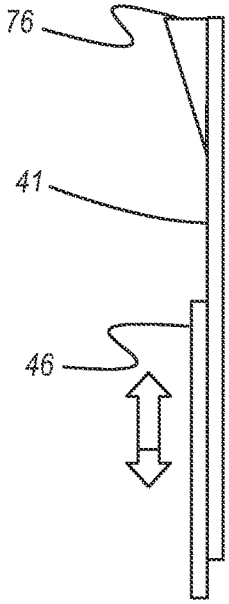
FIG. 12B is a side view of an implementation of a riser baffle and a riser gate feature.

In implementations the gate opening G includes a variable-sized gate opening G. In implementations the gate opening G may be adjusted by a riser gate feature 46 as shown in FIG. 9. The riser gate feature 46 may include a gate adjustment feature 27, or a mechanism to move at least a portion of the riser baffle 41 or riser gate feature 46 to adjust the gate opening G. For example, the riser baffle 41 or riser gate feature 46 may be moved up and/or down through a connection to a gate adjustment feature 27 such as a lever or knob, that may be on the outside surface of the dryer 10 as shown in FIG. 1. In implementations the gate adjustment feature 27 includes a stationary riser baffle 41 and at least one other plate or baffle that may be adjusted to change the gate opening G. For example, as shown in FIG. 12A and FIG. 12B, the riser baffle 41 may have an additional riser gate feature 46, such as a plate configured such that it may move up and down. The riser gate feature 46 may be configured to move up and down automatically and the amount and/or frequency of the movement may be linked to at least one processing parameter sensor. In implementations the riser gate feature 46 includes a secondary plate that is attached to the riser baffle 41 and is configured with a spring loaded mechanism to pull the secondary plate up. In implementations the secondary plate may further be connected with a lever or knob whereby an operator may move it down, once or multiple times, in the event of particle packing as shown in FIG. 9.

The gate adjustment feature 27 may be manual and/or automated. An automated gate adjustment feature 27 may include at least one sensor that monitors at least one processing parameter such as amount of particles 43 in a fluid bed section, or moisture content of the exhaust dryer gas for example.

In implementations the riser baffle 41 or riser gate feature 46 is configured to move up and down and the amplitude of the movement, or distance displaced from center, as well as the rate of movement, may be controlled. For example, the riser baffle 41 or a riser gate feature 46 may move up and down any suitable amount and at any suitable rate to maintain adequate flow of particles 43 through the dryer 10. The amplitude and rate of the movement may be increased when particles 43 become too dense in a fluid bed section.

In implementations the fluid bed dyer 10 is configured for continuous drying of material, whereby a continuous stream of particles 43 is input into the dryer 10 and a continuous stream of dry particles 43 exit the dryer 10, thereby not being a batch process. In implementations a quantity of material or particles 43 may be input into the fluid bed dryer 10 and the dryer 10 may be operated in a batch process. The material fed into the dryer 10 may move through the dryer 10 from one fluid bed section to the next fluid bed section, or at least a portion of the material may be deflected back into a fluid bed section for further drying before proceeding to the subsequent fluid bed section.

In implementations the performance of the dryer 10 may be predicted mathematically from a series of heat and material balances around each fluid bed section. In implementations the performance of the entire dryer 10 may be predicted by sequentially performing a heat and material balance for each fluid bed section, where the temperature and moisture content of particles 43, such as wood chips, entering each fluid bed section is the outlet of the previous fluid bed section. One unknown in the calculations may be the relative humidity of the gas leaving the fluid bed sections. This may be predicted with a few tests and may be related to the moisture content of the chips in each fluid bed section. This mathematical model may be used for determining the number of fluid bed sections required, the amount of primary and secondary dryer gases, and prediction of dryer 10 performance for various feed rates and dryer gas temperatures. Additional constraints on the water removal rate can be implemented based on drying curves. The drying curves describe a drying rate defined by particle moisture content percent versus time. The drying curves may be a function of temperature. The relationship of the drying curve with the temperature may be predictable and may be integrated into the model.

In implementations methods for drying a biomass product may include introducing the biomass product into a chamber in a vessel and injecting a fluidizing media into the chamber fluidizing the biomass product in the chamber's bed. Prior to entering the chamber, the biomass product may have a first moisture content. After a sufficient residence time in the chamber, the biomass product may have a second moisture content. The length of the residence time may depend on the desired moisture content of the final dried biomass product.

In implementations a drying system may have at least one chamber. The chamber may include a bed for drying a biomass product. The chamber may include an inlet for receiving a biomass product. The chamber may include a downcomer in communication with the inlet. The downcomer may direct the biomass product to a low point in the chamber. At the low point a fluidizing media may transport the biomass product up into the chamber. The chamber may further include a riser configured to direct the biomass product being transported by the fluidizing media. The riser may have an inlet at the bottom for the fluidizing media to enter the riser. The fluidizing media may be delivered as a high velocity stream configured to move the biomass product higher in the riser, The chamber may further include a baffle located between the downcomer and the riser.

In implementations a drying system may include one or more chambers contained in one or more vessels. The vessel may be any system or mechanism configured to contain, transport, and/or secure the chambers. In implementations the vessel may be a trailer (such as a truck trailer, a semi-trailer, and the like) configured to locate the drying system in a forested area. In implementations the vessel may be a shipping container such as, by non-limiting example, an intermodal container, a freight container, an ISO container, a hi-cube container, a conex box, a sea can, and the like. The vessel may be placed in communication with a second vessel such that the two or more vessels may operate as a continuous system. The chambers may be in communication with a second chamber. The two or more chambers may be contained in a single vessel. The drying system may further include one or more drying stages. Each chamber may have one or more drying stages. A first drying stage may control a first characteristic (e.g, temperature, fluidizing media speed, residence time, or the like) for example a first temperature in the chamber. A second drying stage may change the characteristic having for example a second temperature in the chamber. The drying system may include any combination of one or more vessels, chambers, and stages. Furthermore the drying system may be a batch system or a continuous system. For example, a single chamber may be a batch system with only one inlet and automatic exit. In implementations a single chamber may be a continuous system with an inlet that continuously receives biomass product and an outlet than continuously removes biomass product.

In implementations a drying system may include a condenser. In a multistage system the condenser may be configured to capture volatilized internal oils and water-soluble aromatic compounds from the biomass product. A first stage of the multistage system may use air below ambient temperature. A second stage of the multi-stage system may use air above ambient temperature.

In implementations a drying system may include a chamber and a fluidizing media introduced into the chamber. Mechanisms used to supply the fluidizing media may include at least one of a pneumatic conveyance, bellow, compressor, fast-acting butterfly valve(s), blower, or any other device configured to deliver the fluidizing media to the biomass product. The fluidizing media may come from a variety of sources including atmospheric air, heated air and/or exhaust air. The supply mechanism may provide a pulsed fluidizing media. The pulsed fluidizing media may be delivered to the chamber on a slow cycle or a very fast cycle. The pulsed fluidizing media may cycle slow enough to allow the biomass material to fully settle. Alternatively, the pulsed fluidizing media may cycle sufficiently fast that the air appears to be an uninterrupted stream. The cycle duration may be optimized to provide the best conditions depending on the characteristics of the biomass material.

Implementations of a biomass drying system are disclosed. In implementations the drying system may be configured to dry a biomass product using a fluidized-bed drying system. A biomass product may, by way of example, include any granular biomass material that can be dried prior to being transported from the point of harvest. For example a biomass product may include woody biomass waste from a defrosting project. The woody biomass waste may be any of a combination of wood chips, needles, bark, leaves, etc. The waste may also come from a plurality of sources including multiple tree species. A compilation of various woody biomass waste products may be referred to as slash.

In implementations the fluidized-bed may be established utilizing an air flow system that allows for efficient fluidization of the biomass product. A fluidized bed dryer may be configured to work with biofuels, such as wood-biomass product, and may also be configured to work with any material that requires drying such as, by non-limiting example, small, irregularly shaped materials.

In implementations the biomass drying system may be configured to minimize energy required for drying by providing precise control over biomass movement through the system by controlling system elements including at least one of baffles, gates, air flow rates, and air temperature. In implementations environmental conditions may be monitored on the interior and/or exterior of the system. Adjustments of the drying system may be made by monitoring the system and controlling the system elements as part of a feedback system. For example, separate stages in the system may provide different temperatures of fluidizing media ranging from sub-ambient (i.e. cold) to temperatures greater than ambient (i.e. hot). Due to numerous physical variables including for example the rate of water absorption from the biomass product to the air, temperatures at which greater amounts of pollution is emitted, and reaction temperatures of oils in the biomass product, the amount of energy added to the system in the form of air speed and air temperature may be finely controlled.

In implementations the biomass drying system may be configured as a small, portable, dryer for chipped woody biomass that may be operated in situ with harvesting operations such as forest thinning. By using air to transport biomass product through the system, moisture out of the system and energy into the system, the biomass drying system may be compact with few moving parts. Unit size may be minimized by high gas to biomass contact, and the energy of the gas may be used as the primary means of material conveyance through the drying stages.

In implementations the biomass drying system may be configured to reduce the moisture content of the biomass product down to desirable content to improve transportation efficiencies. In implementations the biomass drying system may be used to reduce the moisture content of the biomass product down to a moisture content that may be desirable for specific industrial applications. For example, in various commercial applications it may be desirable to chip and dry a biomass product to 10% moisture. The biomass product may then be processed into pellets and sent directly to commercial markets.

In implementations a biomass drying system may be configured to capture internal oils from the biomass material. In implementations the system may capture volatile oils and water-soluble aromatic compounds from woody material as secondary products. For example these oils may include pine oils that are light, fragrant, primarily mono- and sesqui-terpene compounds that may be used as bio-based solvents, fragrances, pharmaceuticals, biocides, adhesives and polymers. Water in the biomass material that may be released during the drying may also contain soluble chemicals such as organic acids, which may have applications as fungicides and biocides. Furthermore, capturing the volatile oils and water-soluble aromatic compounds reduces pollutants released from the drying of biomass material.

In implementations the biomass drying system may include at least one chamber having a continuous fluidized bed. The continuous fluidized bed may be established by utilizing an air flow system that moves air through the chamber, continuously fluidizing the biomass product in the bed.

In implementations the fluidization may include cyclic movement of the biomass material to prevent the air from creating holes through the biomass material. Allowing the air to escape through holes or channels the air creates through the biomass material without significantly disrupting the material may be referred to as "rat holing". For example, the air may be energetically pulsed through the biomass material allowing the material to move, while preventing rat holing. The pulses of air may be delivered to the chamber on a slow cycle or a very fast cycle depending on the conditions of the biomass material including size, weight, type, and moisture content. In implementations the pulsed air cycle may be slow enough to allow the biomass material to fully settle. In implementations the pulsed air cycle may be sufficiently high that the air appears to be an uninterrupted stream creating a continuous or near continuous fluidized bed. The cycle duration may be optimized to provide the best conditions depending on the characteristics of the biomass material. Mechanisms used to create the pulses include, by non-limiting example: a pneumatic conveyance; a bellow; a compressor; a fast-acting butterfly valve(s); a blower; or any other device configured to deliver pulses of air to the biomass product. The pulses of air fluidize a material to be dried, such as wood biomass product or food particles.

In implementations the fluidization of a biomass product may include a constant stream of air delivered to the chamber. The air may be delivered to a downward sloping channel or bed, also referred to herein as a "downcomer." The downcomer may be at a downward angle of anywhere between 0 and 90 degrees. The angle in implementations may be between 25 and 65 degrees. The angle in implementations may be about 45 degrees. The air may be delivered to the bed through an upward sloping channel or bed, also referred to herein as an "riser." The riser angle may be anywhere greater than 0 degrees up to vertical. In implementations the riser may be vertical. The riser may be configured to direct the biomass product upward.

In implementations the downcomer and the riser may have an opening connecting their respective separate channels. In implementations the downcomer and the riser may be in a single chamber and distinguished by different air velocities. The different air velocities may be referred to as a "high velocity" and a "low velocity" with the high velocity being greater than the low velocity. In implementations the downcomer may have a low velocity air supply and/or the riser may have a high velocity air supply. In implementations the downcomer may have no air supply and/or the riser may have an air supply with sufficient velocity to transport the biomass product up the riser. In implementations the low velocity air supply and/or the high velocity air supply may be a pulsed air supply and/or a constant air supply.

In implementations a drying system may include a chamber with a downcomer section and a riser section. In implementations the chamber may have a downcomer without a riser section but still have a high velocity air supply below the downcomer to transport the biomass material back to the downcomer. The riser may provide the biomass product a high energy exposure to the fluidizing media. The downcomer may provide the biomass product a low energy longer duration mixing with the fluidizing media. The fluidizing media and/or downcomer may provide the biomass product a transport mechanism to move the biomass product through the dryer system. The biomass product may first enter the downcomer section and be motivated through the downcomer section by an upward flowing low-velocity drying gas. This section may be fluidized by low-velocity drying gas introduced into the downcomer by gas nozzles, slots, jets or any known or otherwise developed air port. This low-velocity drying gas may be controlled by either the supply source (e.g. pump, fan, compressor, exhaust, etc.) or by the opening into the downcomer (e.g. nozzle, slot, jet, etc.). The low-velocity drying gas may provide at least enough fluidization to induce the biomass product to flow freely by gravity. The low-velocity drying gas may have enough velocity to continuously mix the biomass product as it flows through the downcomer. Optionally, the downcomer may operate without a fluidizing media. While passing through each downcomer, the biomass product may be continuously mixed by the jets of drying gas from the slots. This jetting action prevents rat holing, while still providing the mixing action needed for effective use of the drying gas during moisture removal. The drying gas velocity may be limited such that it may be not capable of moving the biomass product up the downcomer or otherwise impeding fluidized flow down the downcomer. In implementations the material in the downcomer may be barely fluidized if at all. It may be preferable that the material stay well mixed so the biomass product is dried evenly. The combination of gravity and air flow through the downcomer keeps the biomass product fairly well mixed.

In implementations a drying system may include one or more chambers contained in one or more vessels. The vessel may be any system or mechanism configured to contain, transport, and/or secure the chambers. In implementations the vessel may be a trailer (such as a truck trailer) configured to locate the drying system in a forested area. The vessel may be placed in communication with a second vessel such that the two or more vessels may operate as a continuous system. The vessel may be placed in communication with a second vessel such that the two or more vessels may operate as a continuous system. The chambers may be in communication with a second chamber. The two or more chambers may be contained in a single vessel. The drying system may further include one or more drying stages. Each chamber may have one or more drying stages. A first drying stage may control a first characteristic (e.g. temperature, fluidizing media speed, residence time, or the like) for example a first temperature in the chamber. A second drying stage may change the characteristic having for example a second temperature in the chamber. The drying system may include any combination of one or more vessels, chambers, and stages. Furthermore the drying system may be a batch system or a continuous system. For example, a single chamber may be a batch system with only one inlet and not automatic exit. In implementations a single chamber may be a continuous system with an inlet that continuously receives biomass product and an outlet that continuously removes biomass product.

In implementations the biomass product may travel sequentially from bed to bed. As diffusion of water from the biomass product limits the water removal rate in the last dryer beds the downcomer size may be increased, or the dryer gas rate may be decreased, to more effectively use the available drying gas. Recirculation or recycling of the riser biomass product back to the bed allows good mixing and higher residence time in these beds. Excellent mixing of the drying gas and the biomass product allow the necessary heat for drying to be transferred at much lower temperatures. In implementations mixing allows the outlet air to be nearly saturated with water. This may cool the bed to near the wet-bulb temperature (about 55° F. without heat addition). Drying performance may be predicted from basic heat-and-heat-material-balances by using a time-slice analysis.

At the bottom of the downcomer the biomass product may be agitated and/or accelerated by a high velocity jet of drying gas. The biomass product may then be conveyed rapidly upward in the riser. In implementations there may be no riser but a high velocity jet of drying gas may accelerate the biomass product up into the chamber and/or to the top of the downcomer without the restriction of a riser. In implementations the top of the riser may include a deflector. In implementations the deflector may be configured to divide the fluidized biomass stream. A controlled fraction of the biomass product striking the deflector may be recycled back to the downcomer bed, while the remaining fraction of the biomass product is conveyed onward to the next bed. In implementations the deflector may also include a gate allowing greater control of the biomass stream by preventing it from recycling or advancing or substantially limiting the amount of the stream that is recycled or advanced. The deflector and/or gate may be incorporated into a drying system with a single chamber or a drying system with multiple chambers. Moreover, the deflector and/or gate may be incorporated into a batch system and/or a continuous system. For example, in a batch the dryer system may maintain the biomass material in a single chamber until the desired moisture content is reached. A system controller may then open the gate to allow the fluidizing media to force the biomass material out of the chamber and into a collection bin. In implementations the gate and/or deflector may direct the biomass material to advance to a second chamber in the same vessel. In implementations the gate and/or deflector may direct the biomass material to another vessel and/or a collection bin to be processed through another vessel.

In implementations the biomass product may be transported through a system of drying stages separated by the adjustable baffles. In implementations a first chamber and a second chamber may be separated by a baffle. For example, a downcomer may be separated from a riser by a baffle. In implementations a riser may be separated from a subsequent downcomer by a baffle. In implementations a baffle may be used to release biomass product to a storage container or the like. An adjustable baffle may be used in the drying system to optionally compensate for variation in raw material moisture contents by allowing for more resident time in the downcomer. For example, a baffle located where the downcomer and the riser connect may be adjustable such that it may allow a variable amount of biomass material into the riser. The baffle between the downcomer and the riser may be raised or lowered, creating a gate that allows a controlled amount of material to enter the bottom of the riser. In implementations a plurality of communicating chambers with downcomers and risers in each chamber may allow the drying of larger undried particles and the removal of smaller dried particles from the system by controlling the opening on baffles separating the downcomers and risers and each of the chambers.

In implementations the biomass product may be controlled by the fluidizing media (such as air) carrying the biomass product through the system in a way such that smaller, more easily dried particles pass through more quickly, allowing the bulk of the particles to be slowed down by the baffles and to exit the system at the desired moisture content. The velocity may be considerably higher in the riser as the biomass product exits the downcomer and enters the riser near the baffle. A variable opening nozzle at the bottom of the riser may control the amount of air entering the riser. By manipulating the gate and the nozzle very good control over the flow of material may be maintained.

Pneumatic conveyance may also be used to move the biomass product from bed to bed. Multiple beds may be used in order to vary dryer gas rates and temperatures in different parts of the system. The movement of the biomass product from bed to bed is performed by transporting the biomass product upward and onward as the biomass product leaves each bed. In this process the biomass product is propelled with more gas and much more violently than during fluidization. It has the advantage of causing very thorough mixing as the biomass product moves from bed to bed, and allows the bed depths to be varied from bed to bed. The biomass product moves along each individual bed by gravity. Once fluidized the biomass product acts like water and flows along a slanted bed.

In implementations the slant of the downcomers, followed by the riser, results in a saw-tooth shaped layout. In implementations the layout of the dryer system may slope, so the saw-tooth shape is less pronounced. In implementations the dryer system may have a horizontal layout.

In implementations a micro-computer may be used to control temperature, residence time, velocity, and/or pulse interval for the air introduced into the system. Sensors in the dryer system may provide a feedback mechanism to the microcomputer allowing the computer to control the baffles, gates, and air supply (including velocity and temperature)

effectively controlling residence times of the biomass product in the various beds and stages allowing for optimal drying. Such sensors may include, by non-limiting example: air temperature sensors; biomass material temperature sensors; pressure sensors; relative humidity sensors; dew point sensors; inferred image of biomass sensors; air velocity sensors; mass air flow sensors; biomass material weight sensors; biomass material weight change sensors; and/or any other known or developed sensor. Although conditions may change from the first to the last dryer bed, these same feedback control systems may be employed so the same bed physical design may be set to perform at any location in the dryer. Varying the size and/or geometry of the air ports, the slope and geometry of the beds, and/or other system characteristics may also provide a way to control the efficiency of the system.

In implementations the dryer system may control the residence time in any particular bed to allow the water in the biomass product to diffuse to the surface where it may be swept away by the passing air. Residence time may be increased in implementations by having a fairly high holding volume in the beds near the downcomer outlet and/or reducing the air rates.

In implementations the drying system may include a multi stage system. In implementations each stage in the drying system may use a different air temperature. In implementations, the temperature may increase as stages progress. In implementations, the temperatures may decrease as the stages progress.

In implementations a first stage may be a cold air stage (i.e. ambient temperature or less). This first stage may reduce moisture content in the biomass product (e.g. surface water). For example, in implementations the moisture content may decrease from about 50% to about 35% in the first stage. In implementations the moisture content may decrease from about 50% to about 25% in the first stage. Given enough residence time in the system cold air may be able to reduce the moisture content to about 200/%. Using cold air to reduce the moisture content may substantially increase the biomass product's resident time in one or more chambers in order to reduce the moisture content down to an optimal range. However, by using cold air to reduce the moisture content, volatilization of the internal oils may be minimized. The low temperature operation reduces the chance of oxidation of volatile compounds and fines which may create "blue haze." The cold air exhaust may be released directly to the atmosphere and/or pass through a particulate control cyclone prior to being released into the atmosphere. In implementations one may run the outlet air as close to saturated (100% relative humidity) as possible.

In implementations a second or subsequent stage may be a hot air stage (i.e. air greater than ambient temperature). This second stage may quickly reduce moisture content in the biomass product without increased residence time in the system. In implementations a hot air stage may dry the biomass product to about 20% moisture content. In implementations a hot air stage may dry the biomass product to about 10% moisture content. Furthermore, a hot air stage may rapidly volatilize the internal oils allowing them to be released into the atmosphere and/or be captured. In implementations the volatilized internal oils may be collected in a condenser. The hot air stage internal oil removal/collection efficiency may be increased by reducing the biomass product to a low moisture content relative to internal oil content. The process may further include separating the condensed oils from additional condensed water via gravity separation. The hot air exhaust from the heated stage may be condensed to recover internal oils and/or the heated air may also be released to the atmosphere after passing through a cyclone. In implementations the hot air may be greater than 160° F. at which temperature it is believed that blue haze may form. In implementations the air may be less than 160° F. substantially preventing the blue haze from forming and/or limiting volatilization of internal oils. In implementations the hot air may be greater than 450° F. at which temperature some biomass products such as woody material may begin reacting with the air (e.g. oxidizing). In implementations the hot air may be less than 450° F., keeping the biomass products such as woody material from reacting. In implementations the hot air may be greater than 200° F. In implementations the air may be less than 200° F. For certain commercial applications it may be beneficial to dry the biomass material at temperatures as high as 1000° F. to remove substantially all moisture from the biomass product.

In implementations the drying system may operate with one or more stages. A first stage may be either a hot air stage or a cold air stage. Similarly, a second or subsequent stages may be either hot air or cold air stages. Furthermore the system may operate with one or more cold air stages. For example, the heated stage may be disengaged if oil capture is not desired and residence time in the system is not an issue. The system may alternatively operate with one or more hot air stages. For example, the system may operate with only hot air stages if residence time in the system is an issue. Single vessels, multiple vessels, single chamber, and multiple chamber systems may each operate with one or more stages, having for example both a hot and cold stage. Furthermore, both batch and continuous systems may operate as either a single stage system or as multi-stage systems, having for example both a hot and cold stage.

The temperatures in the stages may be optimized according to drying needs (e.g. final moisture content, recovery of oils, etc.), available drying time frames (i.e., the length of time biomass product resides in the system), and/or desired efficiency. For example, separate cold and hot stages may maximize energy efficiency. In implementations the temperature may be controlled in response to feedback received from any of a variety of sensors (e.g. relative humidity, weight, inferred, direct product sampling, etc.) indicating the relative reduction in the moisture of the biomass product. In implementations heat may be added to the drying air by incorporating waste heat from support machinery (generators, blowers, downstream processing equipment, etc.).

Figure 13:
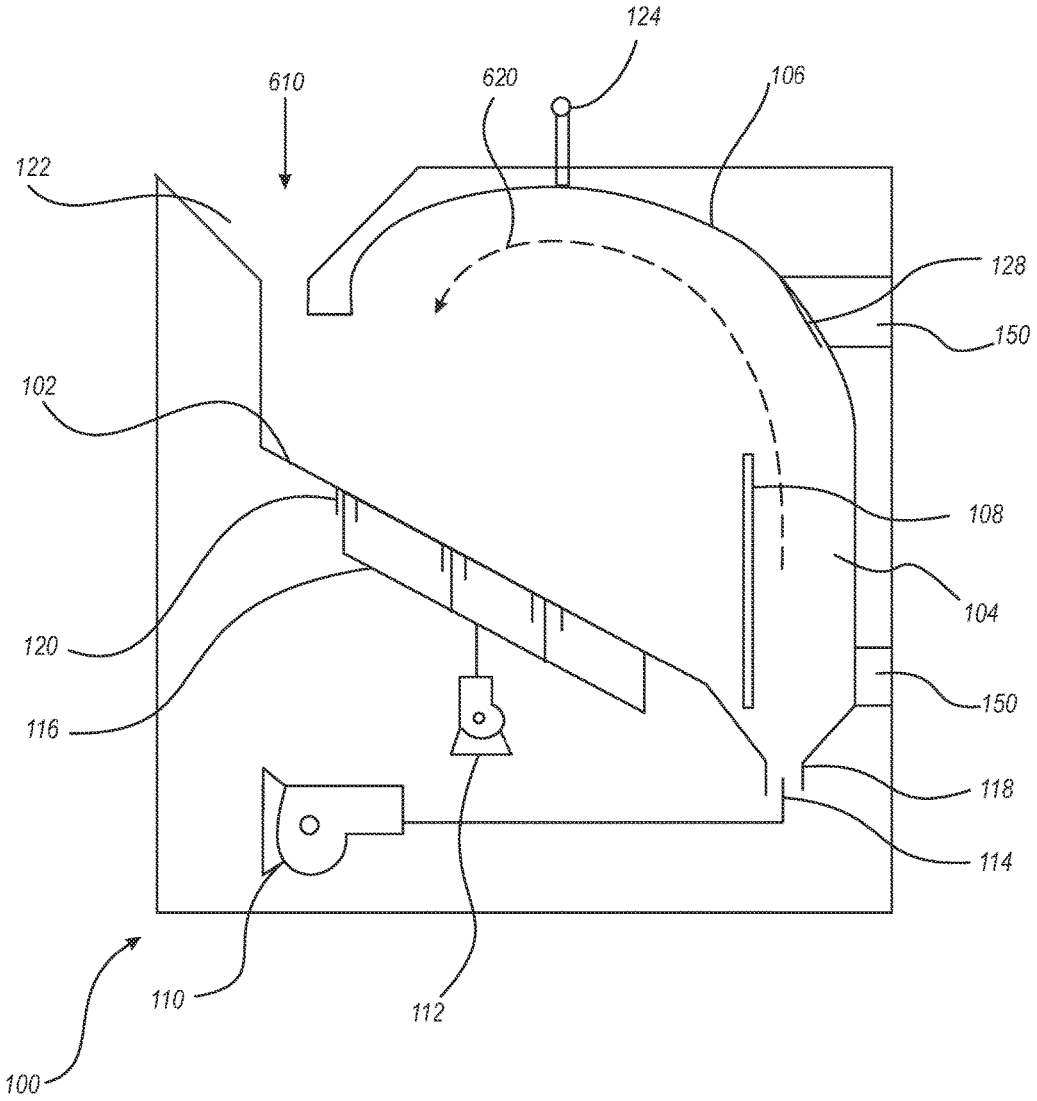
FIG. 13 is a schematic of an implementation of a single chamber biomass dryer system.

In implementations, as illustrated in FIG. 13, a dryer system 100 may include a biomass product intake 122 for directing biomass product (biomass material) 610 into a vessel having a bed 102 having air ports 120 for fluidizing a biomass product 610. Bed 102 may be a downcomer sloped sufficiently to transport biomass product 610 when fluidized by air delivered from air ports 120. Air ports 120 include any nozzle, baffle, perforation or the like in downcomer 102 sufficient to deliver enough air through downcomer 102 to fluidize biomass product 610 and sufficiently transport biomass product 610 along the length of downcomer 102. Air may be plumbed to air ports 120 though air delivery system 116 in any manner sufficient to deliver a low velocity air in enough quantity to fluidize biomass product 610. Air supply 112 may provide air delivery system 116 with sufficient air to fluidize the biomass material, mixing it and transporting it down downcomer 102. Air supply 112 may be any air supply system including for example, air pumps, fans, compressors, billows, etc. Downcomer 102 may direct biomass product 610 to a riser 104. In implementations a baffle 108 may separate downcomer 102 from riser 104. Baffle 108 may also be configured to open and close, controlling the flow and amount of fluidized biomass product 610 into riser 104. In implementations riser 104 may receive air supplied through an air port 118, through an air delivery system 114, from air supply 110. Air supply 110 may be configured to provide air delivery system 114 with sufficient air supply to expel air from air port 118 at a sufficient velocity to propel biomass product 610 up riser 104. In implementations biomass product 610 is propelled against a deflector 106 along the product path 620 depicted by the dotted line in FIG. 13. In implementations an exit port 150 may be located at the bottom and/or the top of riser 104. In implementations exit port 150 may be used to extract material from the chamber when the chamber functions as a batch system. In implementations exit port 150 may be used to direct biomass product 610 to a second chamber. Gate 128 may cover exit port 150 preventing biomass product 610 from exiting the system at an undesirable time. However, Gate 128 may be manually our automatically (e.g. via a micro controller) opened allowing biomass product 610 to exit the system. Gate 128 may also function as a deflector plate, directing biomass product 610 into exit port 150. Air supply 110 may be any air supply system including for example, air pumps, fans, compressors, billows etc. Drying system 100 may also have an exhaust port 124 for removing air from the system as the air collects moisture from biomass product 610. In implementations a condenser and/or a cyclone may be connected to the exhaust air or exhaust port 124 to remove oils and particulate matter from the exhaust stream. In implementations the drying system 100 may also include at least one of a biomass product temperature sensor, an air temperature sensor, a biomass product weight sensor and a relative air humidity sensor.

Figure 14:
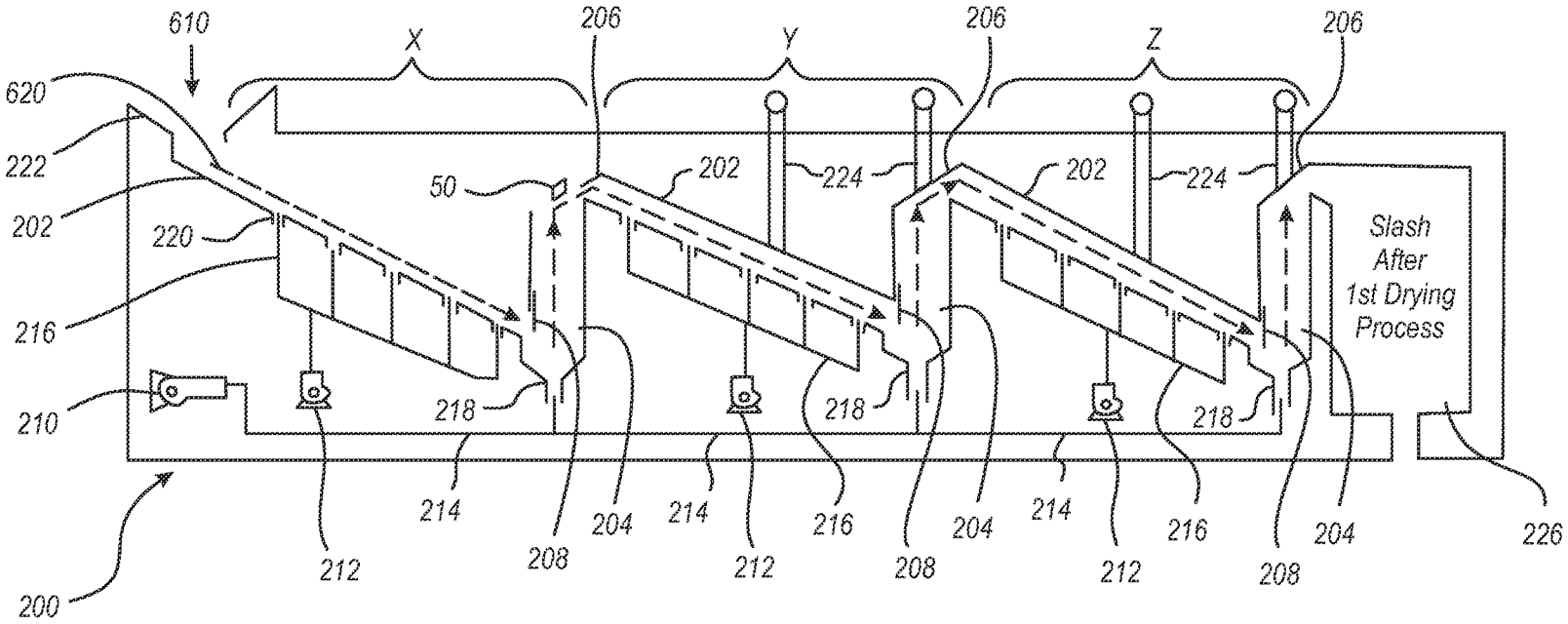
FIG. 14 is a schematic of an implementation of a multi-chamber biomass dryer system.

In implementations, as illustrated in FIG. 14, a dryer system 200 may include a biomass product intake 222 for directing biomass product 610 into vessel having a series of downcomers 202 and risers 204 along biomass path 620 (shown as a dotted line) through multiple stages illustrated as X, Y, and Z. Air may be directed to the downcomers by delivery system 216 from air supply 212. Air may also be directed to the risers 204 by delivery system 214 from air supply 210. Low velocity air delivered through air ports 220 may be sufficient to fluidize the biomass product and allow it flow down downcomer 202 to riser 204. High velocity air delivered through air port 218 may be sufficient to direct the fluidized material up riser 204, against a deflector 206, and into the next downcomer 202. Baffle 208 may separate downcomer 202 from riser 204. Baffle 208 may also be adjustable to control the flow of biomass product into riser 204. Air introduced into dryer system 200 may be exited through exhaust port 224 directly to the outside air or in accordance with other methods discussed herein. In implementations biomass material will travel through the downcomers 202 and risers 204 in stage X, then stage Y, then stage Z and exit the system in holding vessel 226. In implementations dryer system 200 may include one or more stages; stages X, Y, and Z are merely shown as an example. Furthermore, air supplied to each of the stages may be different in accordance with the moisture content of the biomass material as it reaches the stages. For example, the air supply may be hotter or cooler in each of the zones or delivered at a higher or lower relative velocity in each of the stages in order to optimize efficient drying of the biomass product.

Figure 15:
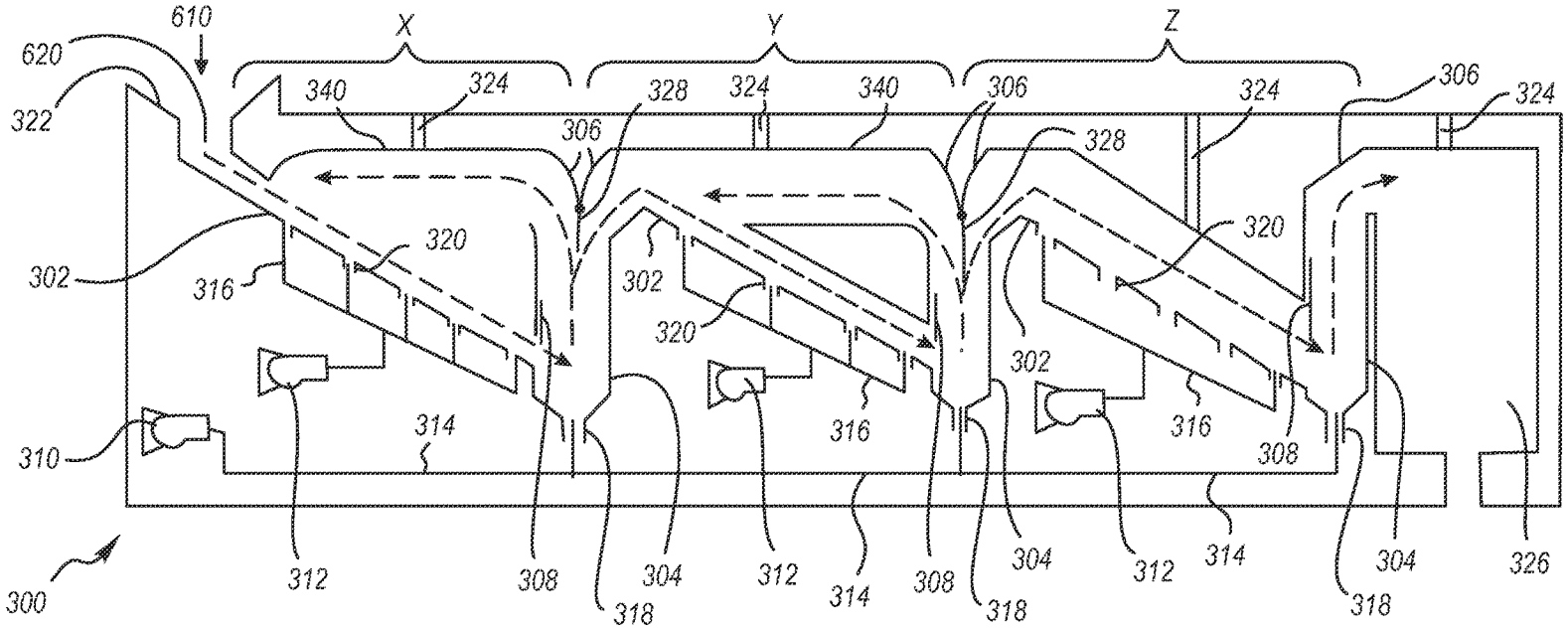
FIG. 15 is a schematic of an implementation of a multi-chamber biomass dryer system with a recycler.

In implementations, as illustrated in FIG. 15, a dryer system 300 may include a biomass product intake 322 for directing biomass product 610 to a vessel having a series of downcomers 302 and risers 304 along biomass path 620 (shown as a dotted line) through multiple stages illustrated as X, Y, and Z. Air may be directed to the downcomers by delivery system 316 from air supply 312. Air may also be directed to the risers by delivery system 314 from air supply 310. Low velocity air delivered through air ports 320 may be sufficient to fluidize the biomass product and allow it flow down downcomer 302 to riser 304. High velocity air delivered through air port 318 may be sufficient to direct the fluidized material up riser 304, against a deflector 306, and into the next downcomer 302. Alternatively, high velocity air delivered through air port 318 may be sufficient to direct the fluidized material up riser 304, against a deflector 306, and into the recycling path 340 returning the material to the same downcomer 302. In implementations gate 328 may direct a portion of or all of the material either back through the same stage or into the next stage. For example gate 328 between stage X and Y may direct the material back through stage X or into the downcomer 302 of stage Y. Baffle 308 may separate downcomer 302 from riser 304. Baffle 308 may also be adjustable to control the flow of biomass product into riser 304. Air introduced into dryer system 300 may be exited through exhaust port 324 directly to the outside air or in accordance with other methods discussed herein. In implementations biomass material will travel through the downcomers 302 and risers 304 in stage X, then stage Y, then stage Z and exit the system in holding vessel 326. Biomass material may also recycle back though stage X and/or stage Y before advancing. In implementations dryer system 300 may include one or more stages; stages X, Y, and Z are merely shown as an example.

Figure 16:
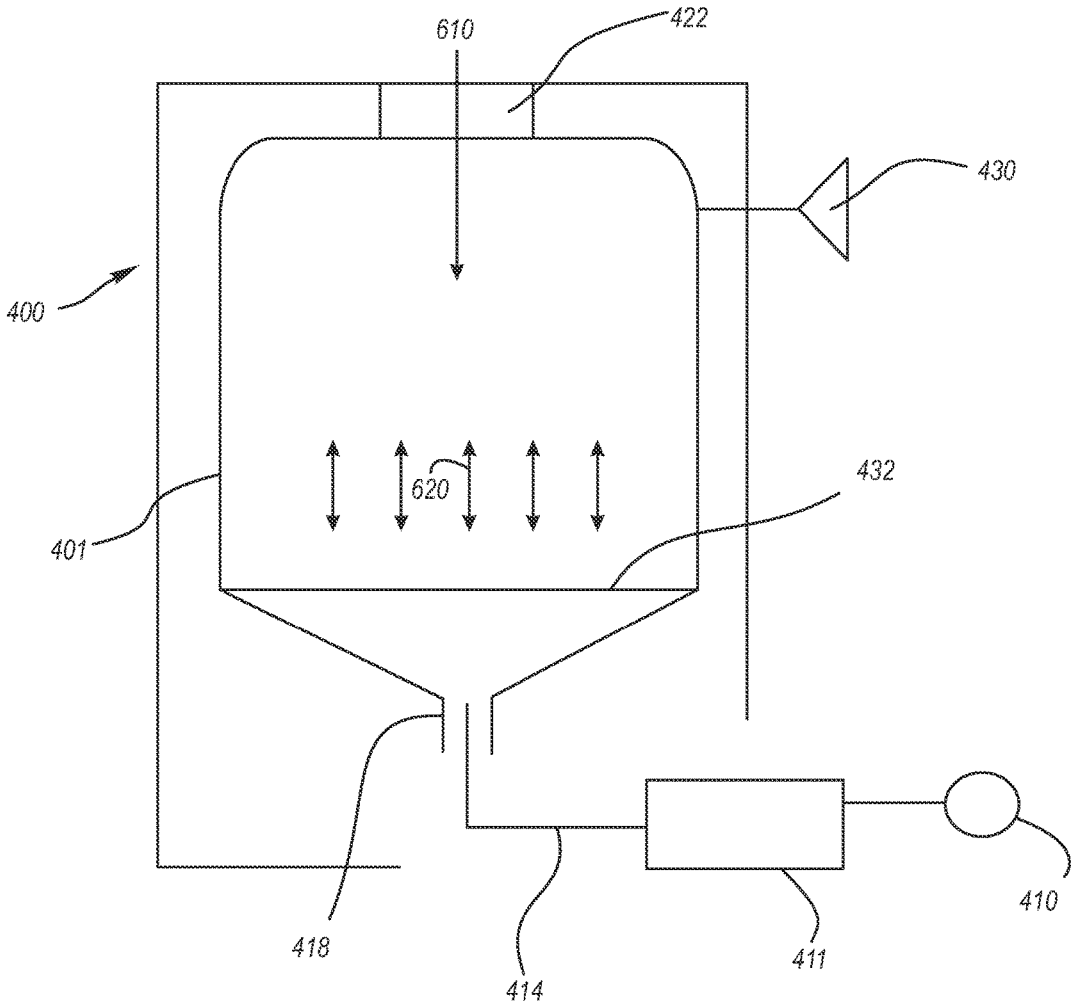
FIG. 16 is a schematic of an implementation of a pulsed batch biomass dryer system.

In implementations, as illustrated in FIG. 16, a dryer system 400 may include a biomass product intake 422 for directing biomass product 610 into vessel 401. Vessel 401 may include a biomass support screen 432 and/or an air port 418. Air port 418 may receive air from delivery system 414 connected to a pulse generator 411. Pulse generator 411 may receive air from an air supply 410. In implementations pulse generator 411 may cause the air supply to be periodic. The periodic or pulsated air supplied through air port 418 may cause the biomass material in vessel 401 to oscillate in such a manner as to fluidize the material, shown by vertical arrows 620. Port 430 may exit the air from vessel 401 and/or absorb the pressure changes in the vessel 401. Port 430 may also connect to a condenser and/or cyclone for oil and/or particulate matter recovery.

Figure 17:
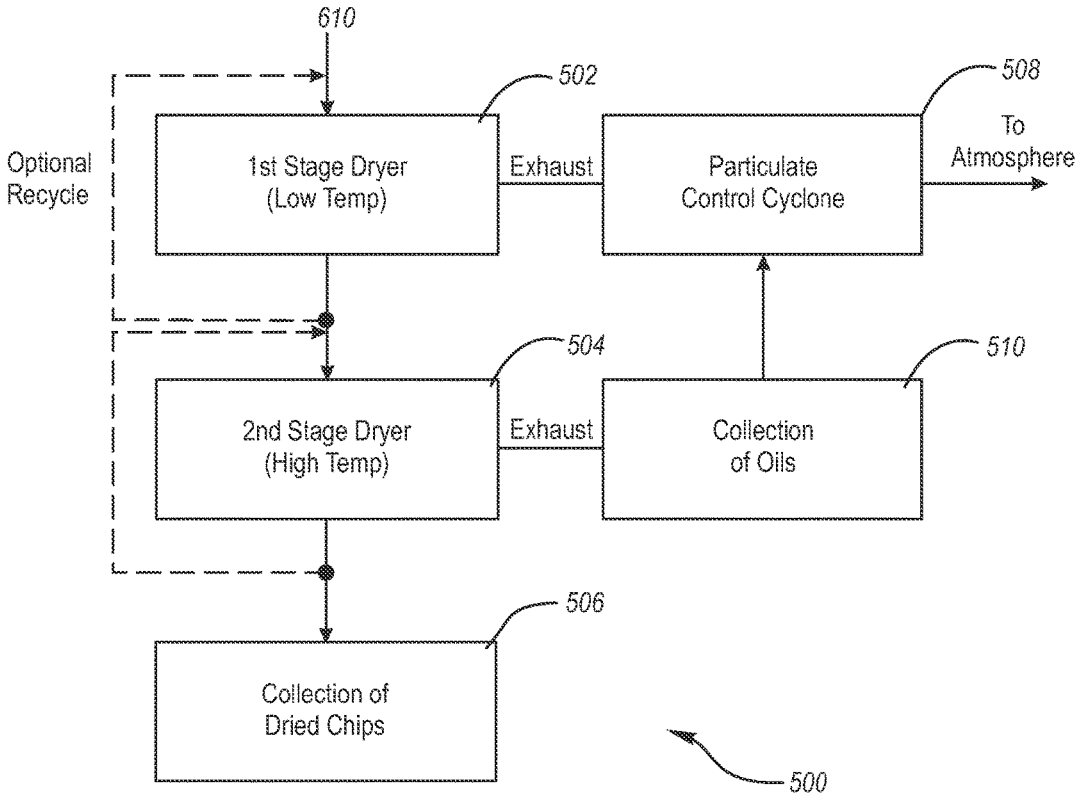
FIG. 17 is a flow diagram of an implementation of a biomass dryer system.

In implementations, as illustrated in FIG. 17, a dryer process 500 may include a first stage dryer (first stage) 502 and a second stage dryer (second stage) 504. Biomass product 610 may be introduced into the first stage dryer 502. Air may be used to dry the biomass product 610 in the first stage dryer 502. First stage dryer 502 may include low temperature air preventing the volatilization of internal oils of the biomass material 610. In response to completion of the first stage dryer 502, biomass material 610 may advance to a second stage dryer 504 or be recycled back into the first stage dryer 502. Second stage dryer 504 may include high temperature air volatilizing the internal oils of the biomass material and reducing the moisture content down to a commercially usable content. In response to completion of the second stage dryer 504 the biomass material 610 may be collected and/or recycled back to the beginning of the second stage dryer 504. Exhaust gases from the first stage dryer 502 may be transported to a particulate control cyclone 508 and then ejected into the atmosphere. Exhaust from the second stage 504 may be sent to a condenser 510 to collect the oils and other products prior to advancing to the particulate control cyclone and ultimately being ejected into the atmosphere. Biomass material 610 upon completing the second stage 504 may be exited to a holding vessel 506.

In implementations one or more fluid bed dryers 10 may be included substantially within one or more vehicle trailers, or within one or more shipping containers, and the like. In implementations one or more fluid bed sections may be sequentially coupled to form a line of fluid bed sections as in FIG. 3 and FIGS. 14-15.

In implementations a method for drying particles 43 using a fluid bed dryer 10 may include introducing a plurality of particles 43 through an inlet 21 into a first fluid bed section 34 of the fluid bed dryer 10; migrating the plurality of particles 43 onto a bed deck 32 of the first fluid bed section 34; injecting a gas towards the plurality of particles 43 through openings 33 in the bed deck 32; migrating some of the plurality of particles 43 towards and through a variable-sized gate opening G included between the bed deck 32 and a riser 42; migrating a portion of the plurality of particles 43 into the riser 42; propelling the portion of the plurality of particles 43 in the riser 42 substantially upwards through the riser 42 by an injection of a gas into the riser 42; directing a first fraction of the portion of the plurality of particles 43 in the riser 42 out of the first fluid bed section 34 and into a second fluid bed section 34' through an outlet using a deflector feature 50; and directing a second fraction of the portion of the plurality of particles 43 in the riser 42 onto a bed deck 32 of the second fluid bed section 34' by interaction with an impingement feature 60. In implementations the outlet may reside between, and be defined by, a divider 44 and the deflector feature 50. In implementations the method may further include tilting the fluid bed dryer 10 to simultaneously alter: an angle between the bed deck 32 of the first fluid bed section 34 and a ground surface below the fluid bed dryer 10, and; an angle between the bed deck 32 of the second fluid bed section 34' and the ground surface.

In implementations of a fluid bed dryer 10 each bed deck 32 may be configured to be independently tilted (independent of any tilting of the fluid bed dryer 10 itself) to alter an angle of the bed deck 32 relative to the ground surface. In implementations of a fluid bed dryer 10 at least one fluid bed section 34 may further include a deflector 50 configured to one of deflect a first fraction of the particles 43 exiting the riser 42 out of the fluid bed section 34, 34', 34", 34'" and deflect a second fraction of the particles 43 exiting the riser back into the fluid bed section 34, 34', 34", 34'" for further drying. In implementations of a fluid bed dryer 10 at least one of the fluid bed sections 34, 34', 34". 34'" may be substantially housed within one of a vehicle trailer and a shipping container. In implementations substantially all of the fluid bed dryer 10, even if it includes multiple fluid bed sections 34, 34', 34", 34'", may be substantially housed within one of a vehicle trailer and a shipping container.

In implementations of a method for drying particles 43 an efficiency of a fluid bed dryer 10 may be increased by having an off-gas (or a gas exiting the fluid bed dryer 10) having as close to water saturation (or 100% Relative Humidity (RH)) as possible. In implementations of a method for drying particles 43 and in implementations of a fluid bed dryer 10 one or more or all of the gases used may be ambient air coming from outside the fluid bed dryer 10. In implementations of a method for drying particles 43 and in implementations of a fluid bed dryer 10 one or more or all of the gases used may be ambient air, coming from outside the fluid bed dryer 10, which has been heated to a predetermined temperature. In implementations a fluid bed dryer 10 may be "scaled up" or "scaled down" either during a manufacturing stage, during an assembling stage, or during a deployment stage (such as at a wood chipping site) by adding or removing fluid bed sections. In implementations a fluid bed dryer 10 may include one, two, three, four, or more than four fluid bed sections. In implementations the off-gas may be recycled back into the fluid bed dryer 10 though, in other implementations, the off-gas may not be recycled back into the fluid bed dryer 10. In implementations, upward facing horizontal surfaces are eliminated from the fluid bed dryer 10 and/or adequate blast doors are incorporated into the fluid bed dryer 10 reduce the risk of, or damage or injury caused by, dust explosions. In implementations a slight vacuum may be created in the fluid bed dryer 10, relative to ambient air pressure outside the fluid bed dryer 10, by pulling/pushing off-gas from the fluid bed dryer 10 with a fan. In such an implementation cold air inlet vents may introduce cold air into the fluid bed dryer 10 along the length of the plenum 30 when the fan is activated, thereby controlling the temperature of any air/gas inside the fluid bed dryer 10 by adjusting the amount of cold air entering the fluid bed dryer 10 through the cold air inlet vents. In implementations some of the particles 43 exiting one or more of the fluid bed sections may be redirected manually (such as by a user) or automatically to be utilized as combustible fuel to heat the air or gas entering the fluid bed dryer 10 or air or gas that is already present inside the fluid bed dryer 10. In implementations heat for heating air or gas entering the fluid bed dryer 10 (or already present within the fluid bed dryer 10) may be created by burning "slash" in the forest or other area near a wood chipping area.

In implementations, aspects of a fluid bed dryer 10 may be mathematically modeled to predict and/or optimize operation. In implementations a heat-and-material balance over each bed deck 32 or fluid bed section 34, 34', 34", 34'" may allow prediction of the bed-deck 32 or fluid bed section 34, 34', 34", 34'" temperature. In such an implementation the humidity leaving the fluid bed section may need to be assumed. A drying curve of moisture-content versus time may be used to update this assumption. In implementations, particles 43 (such as wood chips) with measured moisture content may be dried in fluid bed dryer 10 for a measured amount of time and then checked again for moisture content. Several passes/runs may be used to get points at different times. In implementations the gas/air rate entering/exiting a fluid bed section may be adjusted/optimized so it is sufficient to remove the moisture as quickly as it is released from the chips/particles 43. Equations to represent the drying curves may be created using the Solver function in MS Excel so they can then be used in a dryer model.

The heat balance modeling may be performed in MS Excel using the Goal-Seek feature to calculate/estimate the off-gas moisture content. The calculation may be performed sequentially from the wetter end of the fluid bed dryer 10 with the temperature and/or temperature increase/decrease to the next fluid bed section(s) being known. A test fluid bed dryer 10 may be evaluated by time-slice heat and material balances from test runs. With the gas and fluid bed section temperatures known and/or estimated/calculated, the least accurate measurement may be the relative humidity (RH) of the off-gas. The heat balances may allow calculation of moisture being removed in each time-slice (such as 1 minute intervals), and the accumulated water removal during the test may be compared to the before and after moisture content of the particles 43.

In implementations a three ton per hour fluid bed dryer 10 (i.e., a fluid bed dryer 10 capable of removing three tons of moisture per hour) may be built into a shipping container.

The plenum 30 may be just above the floor of the shipping container, and room for the exhaust gas may be present just above the bed decks 32 or fluid bed sections 34, 34', 34", 34'''. In implementations variable vents along the plenum 30 may admit cold air to maintain control of the temperatures within each fluid bed section. In industrial settings low temperature waste heat may be available for the lower temperature fluid bed sections (such as, in implementations, fluid bed sections closer to the back end, or drier end). In implementations the amount of particles 43 in each fluid bed section may be adjusted or optimized either in conjunction with the amount of particles 43 in one or more other fluid bed sections or independent of the amount of particles 43 in any other fluid bed section. In implementations such adjustment or optimization may occur before deployment and in implementations such adjustment or optimization may occur during use.

EXAMPLE 1

In one example, a dryer system has a single batch chamber with a downcomer, a baffle, and a riser. The downcomer has a downward angle of about 45 degrees receiving a continuous flow of air. The air continuously dries and mixes a woody pine biomass product resident in the downcomer. The bed footprint is 12 inches by 6 inches. The riser is a narrow slot about 3 inches wide and the depth of the bed. The air provided to the system is less than 300 cubic feet per minute (cfm) and has a temperature that is between ambient and 140° F. The deflector in the system deflects the biomass product back to the downcomer.

In places where the description above refers to particular implementations of fluid bed dryers or dryer systems and implementing components, sub-components, methods and sub-methods, it should be readily apparent that a number of modifications may be made without departing from the spirit thereof and that these implementations, implementing components, sub-components, methods and sub-methods may be applied to other fluid bed dryers or dryer systems.

What is claimed is:

1. A method for drying particles using a fluid bed dryer, comprising:

introducing a plurality of particles through an inlet into a first fluid bed section of the fluid bed dryer;

migrating the plurality of particles onto a bed deck of the first fluid bed section;

injecting a gas towards the plurality of particles through openings in the bed deck;

migrating some of the plurality of particles towards and through a variable-sized gate opening comprised between the bed deck and a riser;

migrating a portion of the plurality of particles into the riser;

propelling the portion of the plurality of particles in the riser substantially upwards through the riser by an injection of a gas into the riser;

directing a first fraction of the portion of the plurality of particles in the riser out of the first fluid bed section and into a second fluid bed section through an outlet using a deflector feature, wherein the deflector feature is configured to direct a plurality of particles back into the first fluid bed and into the second fluid bed; and directing a second fraction of the portion of the plurality of particles in the riser onto a bed deck of the second fluid bed section by interaction with an impingement feature.

2. The method of claim 1, further comprising angling the bed deck of the first fluid bed section and the bed deck of the second fluid bed section at an angle to a ground surface below the fluid bed dryer so that some of the plurality of particles move towards and through the variable-sized gate opening at least partly under gravitational force.

3. The method of claim 1, wherein migrating a portion of the plurality of particles into the riser further comprises directing some of the plurality of particles proximate a recessed portion of a riser baffle on one side of the riser and a recess of the riser baffle.

4. The method of claim 3, further comprising adjusting a size of the variable-sized gate opening with a riser gate feature, wherein the riser baffle comprises the riser gate feature, and the riser baffle comprises a first plate, and the riser gate feature comprises a second plate slidably coupled to the first plate.

5. The method of claim 1, further comprising adjusting the injection of the gas into the riser by adjusting a position of a nozzle baffle.

6. The method of claim 1, wherein migrating some of the plurality of particles towards and through a variable-sized gate opening further comprises migrating some of the plurality of particles past one of: variable-shaped openings in the bed deck of the first fluid bed section; openings, in the bed deck of the first fluid bed section, that decrease in size along a longest length of the bed deck of the first fluid bed section; openings, in the bed deck of the first fluid bed section, that increase in size along the longest length of the bed deck of the first fluid bed section; openings, in the bed deck of the first fluid bed section, comprising rectangular slits that have a longest length substantially perpendicular to the longest length of the bed deck of the first fluid bed section; and oval-shaped openings in the bed deck of the first fluid bed section.

7. The method of claim 1, further comprising tilting the fluid bed dryer to simultaneously alter: an angle between the bed deck of the first fluid bed section and a ground surface below the fluid bed dryer, and; an angle between the bed deck of the second fluid bed section and the ground surface.

8. The method of claim 1, wherein injecting a gas towards the plurality of particles comprises injecting a heated gas towards the plurality of particles, the heated gas having a temperature between 200 degrees Fahrenheit and 500 degrees Fahrenheit.

9. The method of claim 1, wherein injecting a gas towards the plurality of particles comprises injecting intermittent pulses of the gas towards the plurality of particles to prevent rat holing.

10. A fluid bed dryer, comprising:

a plurality of fluid bed sections coupled together in sequence, each fluid bed section comprising:

an inlet for introducing particles into the fluid bed section;

a bed deck configured to receive the particles for drying;

a plurality of openings in the bed deck configured to transfer a gas into the fluid bed section for contacting with the particles;

a riser proximate an end of the fluid bed section, the riser comprising a riser baffle, the riser baffle comprising a riser gate feature;

a variable-sized gate opening defined by the riser gate feature and the bed deck, the variable-sized gate opening configured to allow a portion of the particles to pass therethrough into the riser;

an outlet configured to allow a fraction of the portion of the particles to exit the fluid bed section; and a deflector feature configured to direct a portion of the particles from the outlet back into a previous fluid bed section of the plurality of fluid bed sections and a portion of the particles from the outlet into a new fluid bed section coupled to the previous fluid bed section;

wherein the riser is configured to transfer the fraction of the portion of the particles out of the fluid bed section through the outlet by a substantially upward flow of a gas through the riser;

wherein the fluid bed dryer is configured to be tilted to alter an angle of each bed deck relative to a ground surface below the fluid bed dryer, and;

wherein the at least one fluid bed section further comprises a nozzle baffle configured to adjust an amount of gas entering the riser by adjusting between a plurality of positions.

11. The device of claim 10, wherein each bed deck is configured to be independently tilted to alter an angle of the bed deck relative to the ground surface.

12. The device of claim 10, wherein at least one riser baffle comprises one of a recessed portion at a top of the riser baffle and a recess at a bottom of the riser baffle.

13. The device of claim 10, wherein the at least one fluid bed section further comprises a drop out feature at a bottom of the riser configured to remove undesirable material comprised in the portion of the particles entering the riser when the drop out feature is in an open configuration, the drop out feature further comprising a non-open configuration.

14. The device of claim 10, wherein at least one fluid bed section further comprises a deflector configured to one of deflect a first fraction of the particles exiting the riser out of the fluid bed section and deflect a second fraction of the particles exiting the riser back into the fluid bed section for further drying.

15. The device of claim 10, wherein at least one riser baffle comprises a first plate and wherein the riser gate feature comprises a second plate slidably coupled to the first plate.

16. The device of claim 10, wherein at least one of the fluid bed sections comprises an impingement feature configured to redirect gas and particles entering the fluid bed section towards a substantially downward direction.

17. The device of claim 10, wherein at least one of the fluid bed sections is substantially comprised within one of a vehicle trailer and a shipping container.

18. The device of claim 10, wherein the plurality of openings in at least one bed deck comprise one of: variable-shaped openings; openings that decrease in size along a longest length of the bed deck; openings that increase in size along the longest length of the bed deck; rectangular slits that have a longest length substantially perpendicular to the longest length of the bed deck; and oval-shaped openings.

19. A fluid bed dryer for drying biomass, comprising:

a first fluid bed section and a second fluid bed section proximate to the first fluid bed section, the first fluid bed section comprising:

a first bed deck configured to receive biomass particles for drying;

a plurality of openings in the first bed deck configured to transfer a heated gas into the first fluid bed section for drying the biomass particles;

a riser proximate an end of the first fluid bed section, the riser comprising a riser baffle;

a gate opening defined by the riser baffle and the bed deck, the gate opening configured to allow a portion of the biomass particles to pass therethrough into the riser; and a deflector configured to deflect a fraction of the biomass particles exiting the riser out of the first fluid bed section and into the second fluid bed section, wherein the deflector is configured to direct a plurality of particles back into the first fluid bed section and into the second fluid bed section; and the second fluid bed section comprising:

an impingement feature configured to redirect gas and biomass particles exiting the first fluid bed section towards a substantially downward direction;

a second bed deck configured to receive the biomass particles redirected by the impingement feature; and a plurality of openings in the second bed deck configured to transfer a heated gas into the second fluid bed section for further drying of the biomass particles redirected by the impingement feature.

* * * * *